US011404183B2

(12) United States Patent
Mitchell et al.

(10) Patent No.: US 11,404,183 B2
(45) Date of Patent: Aug. 2, 2022

(54) APPARATUS FOR ROBOTICALLY ROUTING WIRES ON A HARNESS FORM BOARD

(71) Applicant: The Boeing Company, Chicago, IL (US)

(72) Inventors: Bradley J. Mitchell, Snohomish, WA (US); Lars E. Blacken, Bothell, WA (US); Damien O. Martin, Everett, WA (US)

(73) Assignee: The Boeing Company, Chicago, IL (US)

( * ) Notice: Subject to any disclaimer, the term of this patent is extended or adjusted under 35 U.S.C. 154(b) by 414 days.

(21) Appl. No.: 16/666,248

(22) Filed: Oct. 28, 2019

(65) Prior Publication Data

US 2021/0125751 A1 Apr. 29, 2021

(51) Int. Cl.
*H01B 13/012* (2006.01)
*H01B 13/02* (2006.01)

(52) U.S. Cl.
CPC ... *H01B 13/01236* (2013.01); *H01B 13/0214* (2013.01)

(58) Field of Classification Search
CPC ..... H01B 13/01209; H01B 13/01227; H01B 13/01245; G06F 30/00; H01R 43/20
See application file for complete search history.

(56) References Cited

U.S. PATENT DOCUMENTS 4,598,469 A 7/1986 Weixel
4,603,476 A 8/1986 Tarbox
4,607,430 A 8/1986 Young
4,653,159 A 3/1987 Henderson et al.
4,677,734 A 7/1987 Bloch et al.
4,715,100 A 12/1987 Cross
4,765,589 A 8/1988 Sauze
4,781,227 A 11/1988 Cross
4,979,544 A 12/1990 Swindlehurst
5,153,839 A 10/1992 Cross
6,196,779 B1 3/2001 Falk
(Continued)

FOREIGN PATENT DOCUMENTS

AT 410609 B * 4/2003 ..... H01B 13/01245
CN 108288525 A * 7/2018
JP 2004119444 A * 4/2004

*Primary Examiner* — Peter Dungba Vo
*Assistant Examiner* — Jose K Abraham
(74) *Attorney, Agent, or Firm* — Ostrager Chong Flaherty & Broitman P.C.

(57) ABSTRACT

Apparatus for robot motion control and wire dispensing during automated routing of wires onto harness form boards. The robot includes a manipulator arm and a wire-routing end effector mounted to a distal end of the manipulator arm. The wire-routing end effector is configured for dispensing and routing a wire along a path through form board devices mounted to a harness form board. The wire-routing end effector is moved along a planned path under the control of a robot controller. An end effector path is provided with a set of processes that enable rapid, even fully automatic, development of robot motion controls for routing wires on harness form boards. The system uses a measurement encoder on the end effector that is routing individual wires on a wire harness form board to learn the length of each wire and its length variation.

20 Claims, 34 Drawing Sheets

(56) References Cited

U.S. PATENT DOCUMENTS

| | | | | |
|---|---|---|---|---|
| 6,272,387 | B1 | 8/2001 | Yoon | |
| 7,082,590 | B2 | 7/2006 | Kragh et al. | |
| 8,534,651 | B2 | 9/2013 | Scapa et al. | |
| 8,955,714 | B1 | 2/2015 | Brzon et al. | |
| 9,687,946 | B2 | 6/2017 | Cole et al. | |
| 2017/0266811 | A1* | 9/2017 | Ogawara | B25J 9/1633 |
| 2017/0369271 | A1 | 12/2017 | Mitchell et al. | |
| 2018/0013254 | A1* | 1/2018 | Woon | H01R 43/20 |
| 2018/0088550 | A1* | 3/2018 | Kawase | B23D 33/006 |
| 2018/0138771 | A1 | 5/2018 | Murphy et al. | |
| 2018/0257903 | A1* | 9/2018 | Takada | B65H 65/00 |
| 2018/0267498 | A1 | 9/2018 | Helmick et al. | |
| 2018/0366244 | A1* | 12/2018 | Rougier | H01B 13/01227 |

* cited by examiner

APPARATUS FOR ROBOTICALLY ROUTING WIRES ON A HARNESS FORM BOARD

BACKGROUND

The present invention relates to the field of wire harness fabrication, and in particular to the assembly of wire bundles of varying configurations on harness form boards (hereinafter "form boards"). The terms "wire bundle" and "wire harness" are used as synonyms herein.

Vehicles, such as large aircraft, have complex electrical and electromechanical systems distributed throughout the fuselage, hull, and other components of the vehicle. Such electrical and electromechanical systems require many bundles of wire, cables, connectors, and related fittings to connect the various electrical and electromechanical components of the vehicle. For example, a large aircraft may have over 1000 discrete wire bundles. Often these discrete wire bundles are grouped into assemblies known as wire bundle assembly groups, which may comprise as many as 40 wire bundles and 1000 wires. Wire bundles are typically assembled outside of the aircraft.

In accordance with a typical method for assembling wire bundles, form boards are used to stage a wire bundle into its installation configuration. Typically each wire bundle of a given configuration fabricated in a wire shop requires a customized form board for layup. The form board typically includes a plurality of fixed form board devices which together define the given wire bundle configuration. During wire bundle assembly, the constituent wires are routed along paths defined by the positions and orientations (hereinafter "locations") of the fixed form board devices. However, the precise position of a particular wire, as that wire is passed through or around a form board device, may vary in dependence on the particular bunch configuration of already routed wires within or in contact with the same form board device.

Robots are used to assemble electrical wire harnesses using wire segments cut to length and configured prior to bundling. For example, a layup robot may be used to insert one end of a wire into a connector on a form board and then route the wire through the fixed form board devices to control shape. The second end of the wire is then inserted into another connector.

Robots may be manually trained or programmed for each different harness configuration. A method is needed for managing robot motions for routing wires on harness form boards that does not require significant manual setup or programming for each different harness configuration.

SUMMARY

The subject matter disclosed in some detail herein is directed to methods and apparatus for robot motion control and wire dispensing during automated routing of wires onto harness form boards. The robot includes a manipulator arm (a.k.a. robotic arm) and a wire-routing end effector mounted to a distal end of the manipulator arm. The wire-routing end effector is configured for dispensing and routing a wire along a path through form board devices mounted to a harness form board. The wire-routing end effector is moved along a planned path under the control of a robot controller. The robot controller is a computer or processor configured with executable computer code stored in a non-transitory tangible computer-readable storage medium. An end effector path is provided with a set of processes that enable rapid, and even fully automatic, development of robot motion controls for routing wires on harness form boards.

Typically, wires are each cut with excess wire length. Each end of the wire is processed (stripped, crimped) separately, once before cutting to final length and once after. In accordance with some embodiments, the system uses a measurement encoder on the end effector of the robot that is routing individual wires on a wire harness form board to learn the length of each wire and its length variation. This information is then used to reduce wire scrap and reduce wire bundle assembly labor and flow time through automated double-ended wire pre-processing.

Although various embodiments of methods and apparatus for robot motion control and wire dispensing during automated routing of wires onto harness form boards systems are described in some detail later herein, one or more of those embodiments may be characterized by one or more of the following aspects.

One aspect of the subject matter disclosed in detail below is a wire-routing end effector comprising: a frame; a routing beak attached to and projecting from the frame, wherein the routing beak has a channel configured to guide a wire along a predetermined path relative to the frame as the wire moves through the channel; a drive roller comprising a drive roller shaft rotatably coupled to the frame, wherein the drive roller is arranged to contact a portion of the wire being guided in the channel of the routing beak; a motor having a motor output shaft; a roller drive train operatively coupled to the motor output shaft; a drive shaft operatively coupled to the roller drive train so that the drive shaft rotates when the motor output shaft rotates; a first right-angled drive shaft gear mounted to one end of the drive shaft; and a second right-angled drive shaft gear mounted to one end of the drive roller shaft and intermeshed with the first right-angled drive shaft gear, wherein the first and second right-angled drive shaft gears convert rotation of the drive shaft to rotation of the drive roller shaft.

In accordance with some embodiments of the wire-routing end effector described in the immediately preceding paragraph, the roller drive train comprises a first rubber drive roller affixed to the motor output shaft, a third rubber drive roller coupled to the drive shaft so that the drive shaft rotates when the third rubber drive roller rotates, and a second rubber drive roller configured to convert rotation of the first rubber drive roller to rotation of the third rubber drive roller. The wire-routing end effector further comprises a slotted drive bearing that transmits torque from the third rubber drive roller to the drive shaft while allowing the drive shaft to move up and down without binding.

Another aspect of the subject matter disclosed in detail below is an apparatus for routing a wire, comprising a manipulator arm, a wire-routing end effector coupled to the manipulator arm, and a robot controller configured to control movement of the manipulator arm and rotation of the wire-routing end effector relative to the manipulator arm, wherein the wire-routing end effector comprises: a first frame; and a routing beak attached to and projecting from the first frame, the routing beak having a height which decreases from a point of attachment to the first frame to a tip of the routing beak and having a channel configured to guide a wire along a predetermined path relative to the first frame as the wire moves through the channel, wherein the routing beak comprises an upper beak part having a first groove and a lower beak part having a second groove, wherein the first and second grooves form the channel, and wherein the upper beak part projects forward beyond the lower beak part. Optionally, the apparatus further comprises a force/torque sensor attached to and supporting the first frame and configured to output sensor data representing a force being exerted on the force/torque sensor by the first frame, wherein the robot controller is communicatively coupled to receive sensor data from the force/torque sensor and further configured to control movement of the manipulator arm taking into account the sensor data received from the force/torque sensor.

In accordance with some embodiments of the apparatus described in the immediately preceding paragraph, the wire-routing end effector further comprises: an encoder roller rotatably coupled to the first frame and configured to contact the wire being passed through the routing beak; and a rotary encoder coupled to the encoder roller and configured to convert each incremental rotation of the encoder roller into a signal representing encoder data indicating a direction of each incremental rotation of the encoder roller, wherein the robot controller is connected to receive the encoder data and configured to calculate a length of wire dispensed by the wire-routing end effector based on the encoder data received.

In accordance with one proposed implementation, the wire-routing end effector further comprises: a second frame that is rotatably coupled to the manipulator arm and to which the force/torque sensor is attached; a reelette rotatably coupled to the second frame and configured to contain at least a portion of the wire being guided by the routing beak; a drive roller comprising a drive roller shaft rotatably coupled to the first frame; a motor mounted to the second frame; a roller drive train rotatably coupled to the second frame and operatively coupled to the motor; a drive shaft operatively coupled to the motor by way of the roller drive train; a first right-angled drive shaft gear mounted to one end of the drive shaft; a second right-angled drive shaft gear mounted to one end of the drive roller shaft and intermeshed with the first right-angled drive shaft gear; an idle guide spring clamp arm rotatably coupled to the first frame; an idle guide roller comprising an idle guide roller shaft that is rotatably coupled to the idle guide spring clamp arm; and a spring that urges the idle guide spring clamp arm to rotate in a first rotation direction toward a position at which the idle guide roller forms a nip with the drive roller, wherein the idle guide roller displaces away from the drive roller when the idle guide spring clamp arm is rotated in a second rotation direction opposite to the first rotation direction.

A further aspect of the subject matter disclosed in detail below is a system comprising: a form board; a multiplicity of form board devices fastened to the form board; a manipulator arm; a wire-routing end effector coupled to the manipulator arm and comprising a first frame and a routing beak attached to and projecting from the first frame; and a robot controller configured to control movement of the manipulator arm and rotation of the wire-routing end effector relative to the manipulator arm such that a tool control point at the tip of the routing beak travels along a predefined routing path which has been calculated to avoid the routing beak colliding with any of the multiplicity of form board devices.

In accordance with some embodiments of the system described in the immediately preceding paragraph, at least one of the multiplicity of form board devices is a wire routing device comprising: a second frame comprising upper and lower arms, the lower arm having a hole; a routing clip fastened to the upper arm of the second frame, the routing clip comprising first and second flexible clip arms configured to bend resiliently away from each other, and first and second hooks respectively connected to or integrally formed with the first and second flexible clip arms; and a temporary fastener fastened to the hole in the lower arm and to a hole in the form board, wherein the robot controller is further configured to control movement of the manipulator arm such that the routing beak approaches the routing clip in a first plane, locally dips to a second plane, passes between the first and second flexible clip arms in the second plane, and then locally rises to the first plane.

In accordance with other embodiments, at least one of the multiplicity of form board devices is a first-end wire connector support device comprising: a second frame comprising a lower arm having a hole and a notched projection having a notch; and a temporary fastener fastened to the hole in the lower arm and to a hole in the form board, wherein the robot controller is further configured to control movement of the manipulator arm such that the routing beak places the wire in the notch with a contact attached to an end of the wire hooked behind the notched projection.

A further aspect of the subject matter disclosed in detail below is a wire-routing end effector comprising: a first frame; a force/torque sensor attached to and supporting the first frame and configured to output sensor data representing a force being exerted on the force/torque sensor by the first frame; and a routing beak attached to and projecting from the first frame, the routing beak having a height which decreases from a point of attachment to the first frame to a tip of the routing beak and having a channel configured to guide a wire along a predetermined path relative to the first frame as the wire moves through the channel.

In accordance with one proposed implementation, the wire-routing end effector described in the immediately preceding paragraph further comprises: a second frame that is rotatably coupled to the manipulator arm and to which the force/torque sensor is attached; a reelette rotatably coupled to the second frame and configured to contain at least a portion of the wire being guided by the routing beak; a drive roller comprising a drive roller shaft rotatably coupled to the first frame; a motor mounted to the second frame; a roller drive train rotatably coupled to the second frame and operatively coupled to the motor; a drive shaft operatively coupled to the motor by way of the roller drive train; a first right-angled drive shaft gear mounted to one end of the drive shaft; a second right-angled drive shaft gear mounted to one end of the drive roller shaft and intermeshed with the first right-angled drive shaft gear; a rotary encoder configured to output a signal representing encoder data indicating a direction of each incremental rotation of the drive roller; an idle guide spring clamp arm rotatably coupled to the first frame; an idle guide roller comprising an idle guide roller shaft that is rotatably coupled to the idle guide spring clamp arm; and a spring that urges the idle guide spring clamp arm to rotate in a first rotation direction toward a position at which the idle guide roller forms a nip with the drive roller, wherein the idle guide roller displaces away from the drive roller when the idle guide spring clamp arm is rotated in a second rotation direction opposite to the first rotation direction.

Another aspect of the subject matter disclosed in detail below is a method for retaining a bundle of wires on a form board, the method comprising: (a) moving a wire-routing end effector mounted to a manipulator arm so that a routing beak of the wire-routing end effector contacts a clip while a first portion of a first wire extends outside a channel of the routing beak from a tip of the routing beak and a second portion of the first wire is disposed in the channel, the clip having first and second flexible clip arms which are urged by respective spring forces toward one another; (b) continuing to move the wire-routing end effector so that the routing beak exerts respective separating forces greater than the respective spring forces to cause the first and second flexible clip arms to move to open the clip; (c) continuing to move the wire-routing end effector so that the tip of the routing beak passes between and the second portion of the first wire is disposed between the first and second flexible clip arms of the open clip; (d) continuing to move the wire-routing end effector until the routing beak no longer contacts the first and second flexible clip arms, thereby allowing the spring forces to move the first and second flexible clip arms to close the clip, as a result of which the second portion of the first wire is retained by the closed clip; (e) moving the wire-routing end effector so that the routing beak contacts the clip while a first portion of a second wire extends outside a channel of the routing beak from a tip of the routing beak and a second portion of the second wire is disposed in the channel; (f) continuing to move the wire-routing end effector so that the routing beak exerts respective separating forces greater than the respective spring forces to cause the first and second flexible clip arms to move to open the clip; (g) continuing to move the wire-routing end effector so that the tip of the routing beak passes between and the second portion of the second wire is disposed between the first and second flexible clip arms of the open clip; (h) continuing to move the wire-routing end effector until the routing beak no longer contacts the first and second flexible clip arms, thereby allowing the spring forces to move the first and second flexible clip arms to close the clip, as a result of which the second portion of the second wire is retained by the closed clip, wherein during step (c) a tool center point of the wire-routing end effector follows a first path and during step (g) the tool center point of the wire-routing end effector follows a second path which is offset from the first path.

Yet another aspect of the subject matter disclosed in detail below is a method for routing a wire on a form board configured with form board devices, the method comprising: (a) placing a portion of a wire in a channel of a routing beak of a wire-routing end effector mounted to a manipulator arm such that a contact attached to an end of the wire is positioned forward of a tip of the routing beak; (b) moving the wire-routing end effector and the end of the wire until the tip of the routing beak is at a contact start point overlying a notch of a first-end connector support device which is attached to the form board; (c) further moving the wire-routing end effector and the end of the wire until the tip of the routing beak is at a contact parking point at which the contact on the end of the wire is hooked behind the notch; (d) further moving the wire-routing end effector away from the first-end connector support device until the tip of the routing beak is at a connector reference point beyond a separation plane while the contact remains hooked on the notch; (e) pushing wire out of the routing beak as the wire-routing end effector moves during step (d); (f) gripping the wire at a point near the end of the wire using a gripper of an contact-insertion end effector while the routing beak is beyond the separation plane; (g) moving the contact-insertion end effector and the end of the wire so that the contact is moved away from the notch and inserted into a hole of a first-end connector supported by the first-end connector support device; (h) upon completion of step (g), further moving the wire-routing end effector toward the first-end connector support device until the tip of the routing beak is at a start routing point while the contact remains inserted into the hole of the first-end connector; (i) pulling wire into the routing beak as the wire-routing end effector moves during step (h); (j) further moving the wire-routing end effector so that the tip of the routing beak follows a predefined routing path through at least one form board device; (k) pushing wire out of the routing beak as the wire-routing end effector moves during step (j); and (l) further moving the wire-routing end effector until the tip of the routing beak is at an end point situated on a far side of a wire holding device which is attached to the form board such that a portion of the wire is held by the wire holding device.

Other aspects of methods and apparatus for robot motion control and wire dispensing during automated routing of wires onto harness form boards are disclosed below.

BRIEF DESCRIPTION OF THE DRAWINGS

The features, functions and advantages discussed in the preceding section may be achieved independently in various embodiments or may be combined in yet other embodiments. Various embodiments will be hereinafter described with reference to drawings for the purpose of illustrating the above-described and other aspects. None of the diagrams briefly described in this section are drawn to scale.

Reference will hereinafter be made to the drawings in which similar elements in different drawings bear the same reference numerals.

DETAILED DESCRIPTION

Figure 1:
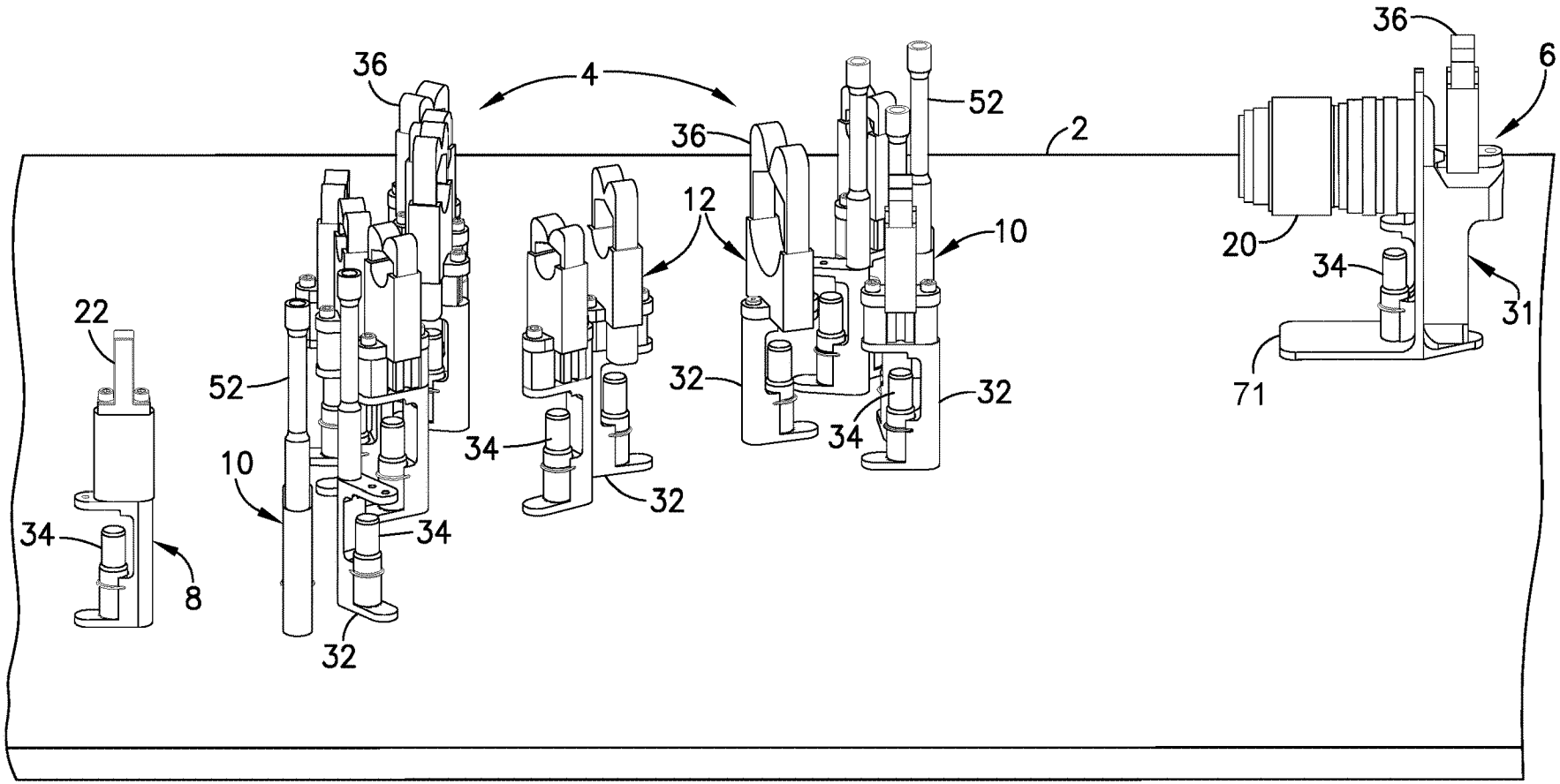
FIG. 1 is a diagram representing a three-dimensional view of a multiplicity of form board devices (including a first-end connector support device, wire routing devices, and a wire end holder) attached to a form board by means of temporary fasteners inserted in respective holes in the form board.

For the purpose of illustration, methods and apparatus for robot motion control and wire dispensing during automated routing of wires onto harness form boards will now be described in detail. However, not all features of an actual implementation are described in this specification. A person skilled in the art will appreciate that in the development of any such embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

In the aerospace industry, wires are typically assembled into wire bundles on a harness form board. Some harnesses may have hundreds or thousands of wires. While the length of the centerline of each wire bundle branch is precisely designed, the length of each wire is not typically known because the individual wires are not typically laid down in a repeatable sequence and/or position within the branch and because the harness is not typically tied in a repeatable sequence. Thus, each individual wire is typically cut extra-long and the wires are trimmed to their final lengths after many of the wires have been placed on the form board and tied together. Trimmed and discarded wire adds extra material cost.

The wire bundle assembly process proposed herein includes the following steps: (1) Individual wires are marked and cut with extra length. (2) The first end of each wire is prepared (strip off insulation, crimp contact). (3) "First-end" connectors are placed on a form board. (4) Robotically place and route each wire onto the form board in a repeatable sequence, including (a) inserting the first end of the wire into a first-end connector; (b) routing the wire to its second-end destination on the form board; and (c) temporarily securing the second end of the wire to the form board by attaching it to a clip or retaining device. (5) When all of the wires of a bundle have been routed, the wires are tied together in a repeatable sequence to secure the form of the wire bundle. (6) The wires are then cut to final length at known locations, which may be printed on the form board. (7) The wire bundle assembly is then removed from the form board. (8) The second ends of the wires are then prepared (strip off insulation, crimp contact). (9) The second ends of the wires of each branch are then inserted into respective second-end connectors.

As the wires are being robotically routed on the form board to their second-end destinations, the wire length is measured by a sensor associated with the robot. The sensor may be an encoder wheel that the wire passes over while being dispensed during routing. The measurement starts after the contact on the first end of the wire has been inserted into the first-end connector and continues until the robot reaches the known location for the wire's second-end cut. An extra amount may be added to the length to account for the length of wire dispensed during the contact insertion function, which insertion operation may be performed robotically using a contact-insertion end effector.

During a routing operation, the tool control point of the wire-routing end effector travels along one predefined path, but the wire itself will likely come to rest along a different path within the bundle. Wires will position themselves within form board wire supports and will roll off of each other in somewhat random ways. Thus, the robot path length and the measured wire length will likely be different. This is why it is important to measure the actual amount of wire dispensed during routing from the first-end connector to the known second-end cut location. The measured lengths are recorded in a database for each wire in the harness.

The above-described process may be repeated over multiple builds of the harness. A statistical analysis may be computed to determine whether the wire lengths are statistically controlled within a specified tolerance. When the wire lengths are statistically controlled within a specified tolerance, several advantages may be realized: The amount of extra length used when cutting wires may be reduced, thus reducing scrap wire and associated material costs.

In accordance with an alternative embodiment, as the wires are being marked and cut, a marking including symbols representing the wire's identity is included as close as possible to the second end of the wire (or to both ends). The marking may be alphanumeric or barcode.

After the wires have been cut to their final length at their respective second ends, the cut ends of the wires are run through an optical scanning system. The optical scanning system identifies each wire from the markings on the respective cut ends and measures the wire's cutoff length. If the system is unable to read the wire identity or measure the wire cutoff length, the cut wire end may be passed through the optical scanning system for repeated attempts. The measured cutoff lengths are subtracted from the initial wire cut length to calculate the final routed length of the wire, which is recorded in a database for each wire in the harness.

The above-described process may be repeated over multiple builds of the harness. A statistical analysis may be computed to determine whether the wire lengths are statistically controlled within a specified tolerance. When the wire lengths are statistically controlled within a specified tolerance, several advantages may be realized: The amount of extra length used when cutting wires may be reduced, thus reducing scrap wire and associated material costs.

In addition, the second ends of the wires may be processed in the same stage during which the first ends are processed, thereby eliminating the preparation of second ends after the harness has been removed from the form board. This transfers work usually done manually after removal of the harness to a stage when the process of preparing ends of the wires may be an automated task, thereby reducing manual labor costs and factory flow time. In addition, automated insertion of the second ends of the wires may be enabled by accurately positioning the prepared second ends of the wires for insertion into the second-end connector.

The automated wire routing process disclosed herein may be performed by a robotic system that includes multiple articulated robots. Each articulated robot may be implemented using, for example, without limitation, a jointed manipulator arm. Depending on the implementation, each articulated robot may be configured to provide movement and positioning of at least one tool center point corresponding to that robot with multiple degrees of freedom. As one illustrative example, each articulated robot may take the form of a manipulator arm capable of providing movement with up to six degrees of freedom or more.

In one illustrative example, the articulated robots of the robotic system may take a number of different forms, such as a wire-routing robot and a wire-insertion robot. Each articulated robot has a tool coordinate system. The tool coordinate system consists of two components: a tool frame of reference and a tool center point (TCP). The tool frame of reference includes three mutually perpendicular coordinate axes; the TCP is the origin of that frame of reference. When the robot is instructed to move at a certain speed, it is the speed of the TCP that is controlled. The tool coordinate system is programmable and can be "taught" to the robot controller for the particular end effector attached to the manipulator arm. In the case of the wire-routing end effector, each path of the TCP may be offset from the previous path during the assembly of a particular wire bundle. One way to achieve this is to program the robot controller with a respective set of motion instructions for each wire path. In the alternative, one motion instruction may be executed in a repetitive loop with incremental offsets being introduced after each pass.

For example, in accordance with one proposed implementation, a method for retaining a bundle of wires on a form board comprises the following steps: (a) moving a wire-routing end effector mounted to a manipulator arm so that a routing beak of the wire-routing end effector contacts a clip while a first portion of a first wire extends outside a channel of the routing beak from a tip of the routing beak and a second portion of the first wire is disposed in the channel, the clip having first and second flexible clip arms which are urged by respective spring forces toward one another; (b) continuing to move the wire-routing end effector so that the routing beak exerts respective separating forces greater than the respective spring forces to cause the first and second flexible clip arms to move to open the clip; (c) continuing to move the wire-routing end effector so that the tip of the routing beak passes between and the second portion of the first wire is disposed between the first and second flexible clip arms of the open clip; (d) continuing to move the wire-routing end effector until the routing beak no longer contacts the first and second flexible clip arms, thereby allowing the spring forces to move the first and second flexible clip arms to close the clip, as a result of which the second portion of the first wire is retained by the closed clip; (e) moving the wire-routing end effector so that the routing beak contacts the clip while a first portion of a second wire extends outside a channel of the routing beak from a tip of the routing beak and a second portion of the second wire is disposed in the channel; (f) continuing to move the wire-routing end effector so that the routing beak exerts respective separating forces greater than the respective spring forces to cause the first and second flexible clip arms to move to open the clip; (g) continuing to move the wire-routing end effector so that the tip of the routing beak passes between and the second portion of the second wire is disposed between the first and second flexible clip arms of the open clip; (d) continuing to move the wire-routing end effector until the routing beak no longer contacts the first and second flexible clip arms, thereby allowing the spring forces to move the first and second flexible clip arms to close the clip, as a result of which the second portion of the second wire is retained by the closed clip. During step (c), a tool center point of the wire-routing end effector follows a first path; during step (g), the tool center point of the wire-routing end effector follows a second path which is offset from the first path.

FIG. 1 is a diagram representing a three-dimensional view of a form board 2 that has a multiplicity of form board devices 4 fastened thereto in a manner that reflects the configuration of a wire bundle to be assembled. In the exemplary configuration depicted in FIG. 1, the form board devices 4 include a first-end connector support device 6 that supports a first-end connector 20, a wire end holding device 8, a multiplicity of single-post wire routing devices 10 and a multiplicity of elastic retainer wire routing devices 12. As will be described in more detail below, the wire end holding device and wire routing devices each include a C-frame 32 and a temporary fastener 34 which is coupled to a lower arm of the C-frame 32. The first-end connector support device 6 includes an L-frame 31 and a temporary fastener 34 which is coupled to a base plate 71 of the L-frame 31. In addition, the wire end holding device 8 includes a wire clip 22, each single-post wire routing device 10 includes a respective post 52 and each elastic retainer wire routing device 12 includes a respective routing clip 36.

As used herein, the term "wire routing device" means a hardware tool that is configured so that, when the wire routing device is fastened to a form board, a portion of the wire routing device will limit movement of a contacting section of a wire in at least one lateral direction which is parallel to the X-Y plane of the form board to which the wire routing device is attached. As used herein, the term "C-frame" means a relatively stiff channel-shaped bracket having mutually parallel upper and lower arms and does not mean a frame having a C-shaped profile. In accordance with the embodiments disclosed herein, the C-frame further includes a member that connects the upper arm to the lower arm.

In accordance with one proposed implementation, the form board 2 is made from a rectangular ⅛-inch-thick perforated sheet with ⅛-inch-diameter holes spaced approximately 3/16 inch (4.7625 mm) apart in a hexagonal pattern. Thus, the vertical spacing between rows is approximately 3/16 (inch)×sin 60°=0.1623798 inch or 4.124446 mm. The sheet is made of aluminum and optionally is coated with a high-friction material. The perforated sheet may be bonded to the top face of a honeycomb core while a second sheet is bonded to the bottom face of the honeycomb core to form a stiff panel.

The form board 2 is typically mounted to or forms part of a support frame (not shown in FIG. 1). The form board devices 4 are attached to the form board by means of temporary fasteners 34 which are inserted in respective holes (not shown in FIG. 1) in the form board 2. The form board assembly illustrated in FIG. 1 is universal in its application, i.e., the form board assembly can be employed to fabricate wire bundles of different designs requiring different deployment of a set of form board devices 4 mounted to the form board 2. In alternative situations, two or more form board assemblies may be placed adjacent to each other for the purpose of assembling a wire bundle in accordance with various alternative configurations.

Figure 2:
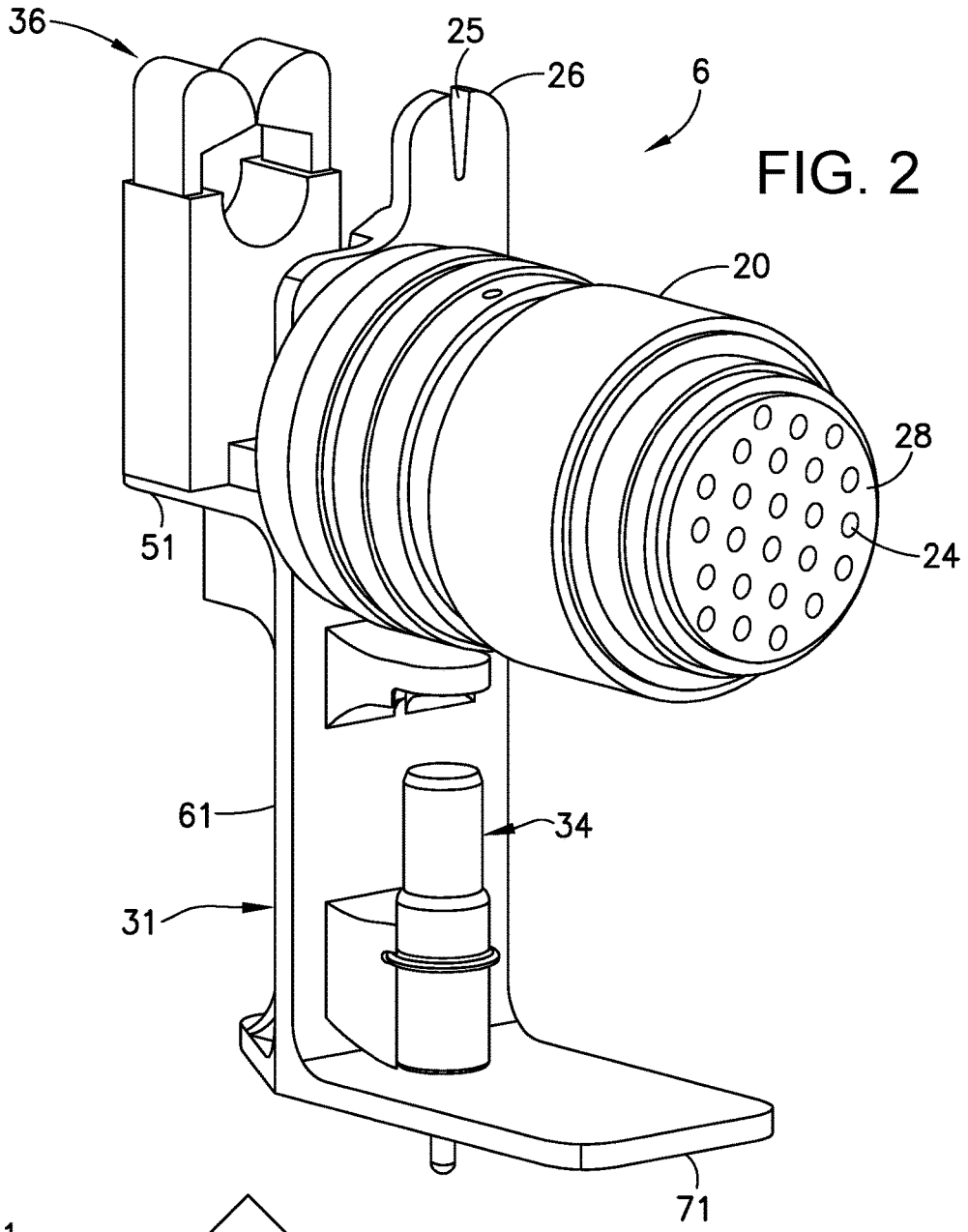
FIG. 2 is a diagram representing a three-dimensional view of a first-end connector support device configured for robotic installation on a form board using a temporary fastener in accordance with one embodiment.

FIG. 2 is a diagram representing a three-dimensional view of a first-end connector support device 6 configured for robotic installation on a form board using a temporary fastener 34 in accordance with one embodiment. The first-end connector support device 6 includes an L-frame 31 having a base plate 71 and a vertical plate 61 perpendicular to the base plate 71. The connector support device 6 further includes a temporary fastener 34 fastened to the base plate 71 and a detent pin (not visible in FIG. 2) which is installed in a hole in the vertical plate 61. The detent pin is a quick-release alignment pin with a solid shank and spring-loaded locking balls. The base plate 71 and vertical plate 61 may be integrally formed or welded together. The base plate 71 has one hole (not visible in FIG. 2) which receives locking pins of the temporary fastener 34.

FIG. 2 shows a first-end connector 20 supported by the first-end connector support device 6 in an elevated position (relative to the form board) with its axis horizontal. More specifically, the first-end connector 20 has been slid onto the aforementioned detent pin. The locking balls on the detent pin hold the first-end connector 20 on the detent pin by spring force (not positive locking) until the first-end connector 20 is pulled off with sufficient force. Thus, the first-end connector 20 may be easily installed, and later removed, by a robot.

The first-end connector 20 also includes a contact-receiving insert 28 having a multiplicity of spaced holes 24. The contact-receiving insert 28 is typically made of dielectric material. For a particular wire bundle configuration, the respective contacts of wires to be terminated at first-end connector 20 are inserted into respective holes 24 in contact-receiving insert 28 by a contact-insertion end effector 18 (seen in FIG. 8E only) attached to the end of a manipulator arm. Prior to contact insertion, however, the wire-routing end effector moves the first end of the wire until a contact crimped on the wire is hooked behind a notch 25 formed in a notched projection 26 of the vertical plate 61.

Figure 2A:
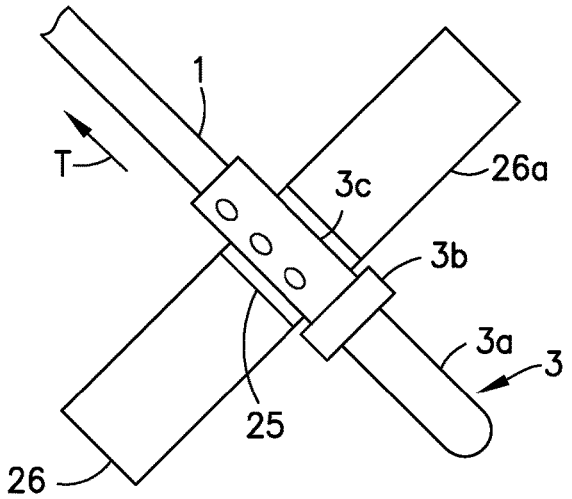
FIG. 2A is a diagram representing a top view of a wire contact hooked behind a notch in a notched projection of the first-end connector support device depicted in FIG. 2.

FIG. 2A is a diagram representing a top view of a wire contact 3 hooked behind a notch 25 in the notched projection 26 of the first-end connector support device 6 depicted in FIG. 2. An unjacketed end portion of the wire 1 has a pin-type contact 3 (made of metal) crimped thereon. The pin-type contact 3 includes a contact pin 3*a*, a locking tab or shoulder 3*b* (which will be retained by a retainer mechanism inside a hole in the first-end connector 20), and a crimp barrel 3*c* having indentations where the crimp barrel 3*c* has been crimped onto the unjacketed end portion of the wire 1. In the example depicted in FIG. 2A, the crimp barrel 3*c* is placed at the bottom of the notch 25 (where the notch is most narrow), while the locking tab or shoulder 3*b* is hooked or latched behind the notched projection 26. More specifically, when the wire-routing end effector later applies a tension on the wire 1 (indicated by arrow T in FIG. 2A), a surface of locking tab or shoulder 3*b* bears against a surface 26*a* of the notched projection 26 on at least opposite sides of notch 25, thereby retaining the first end of the wire 1 in a position wherein the wire 1 is accessible for gripping by the aforementioned contact-insertion end effector. During the next stage of the automated wire bundle assembly process, the contact-insertion end effector 18 grips the wire 1, lifts the first end of wire 1 up and out of the notch 25 and then performs maneuvers which insert (e.g., push) the contact 3 into a targeted hole 24 in the contact-receiving insert 28.

Referring again to FIG. 2, the first-end connector support device 6 further includes a routing clip 36 which is attached to a horizontal platform 51 integrally formed with and projecting from the vertical plate 61 in a direction opposite to the direction in which base plate 71 is projecting. Some of the wire ends are unterminated and/or require other processing before loading into the connector, so they are held temporarily by the routing clip 36. Other wires held by the routing clip 36 are to be installed on other form board devices nearby.

Figure 3:
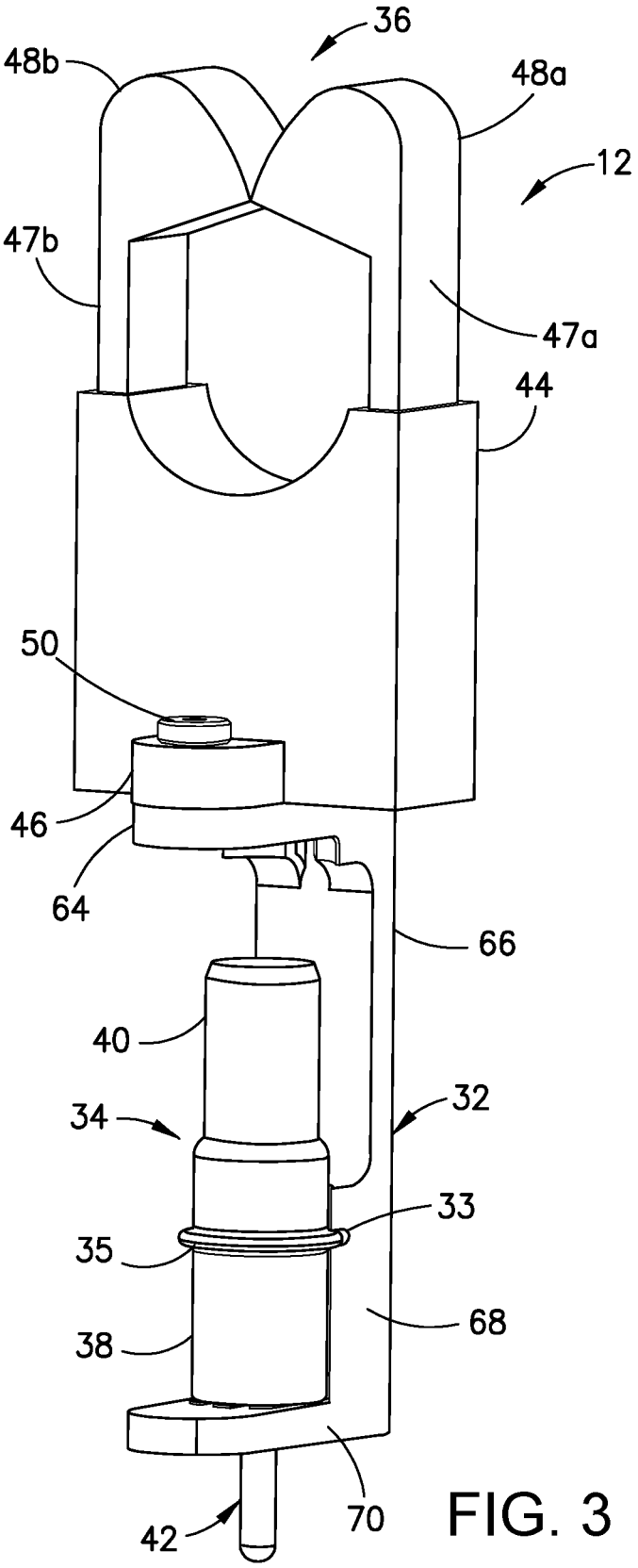
FIG. 3 is a diagram representing a three-dimensional view of a wire routing device that includes a C-frame, a temporary fastener, and a routing clip in accordance with one embodiment.

FIG. 3 is a diagram representing a three-dimensional view of an elastic retainer wire routing device 12 that includes a C-frame 32 made of rigid material (e.g., aluminum), a temporary fastener 34 fastened to the C-frame 32 and a routing clip 36 (also known as an "elastic retainer"). The temporary fastener 34 is configured to initially fasten to the lower arm 70 of the C-frame 32 and later fasten the C-frame 32 to a form board 2 by interacting with a hole in the form board 2. The routing clip 36 is attached to the upper arm 64 of the C-frame 32. The C-frame 32 further includes a fastener retaining block 68 integrally formed with one end of the lower arm 70 and a vertical member 66 having one end integrally formed with one end of the upper arm 64 and another end integrally formed with the fastener retaining block 68.

The temporary fastener 34 includes a cylindrical housing 38 with an annular flange 35 extending around the housing 38. A plunger 40 is slidably coupled to the housing 38. A portion of the plunger 40 projects from one end of the housing 38. A spacer (not visible in FIG. 3) and a pair of locking pins 42 project from the opposite end of the housing 38. A spring is contained inside the housing 38. The locking pins 42 are connected to the plunger 40 and displace with the plunger 40 when the plunger 40 is pushed further into the housing 38. The aforementioned spacer is fixed relative to the housing 38. A portion of the annular flange 35 sits in an arc-shaped groove 33 formed in the fastener retaining block 68 of the C-frame 32.

Figure 9:
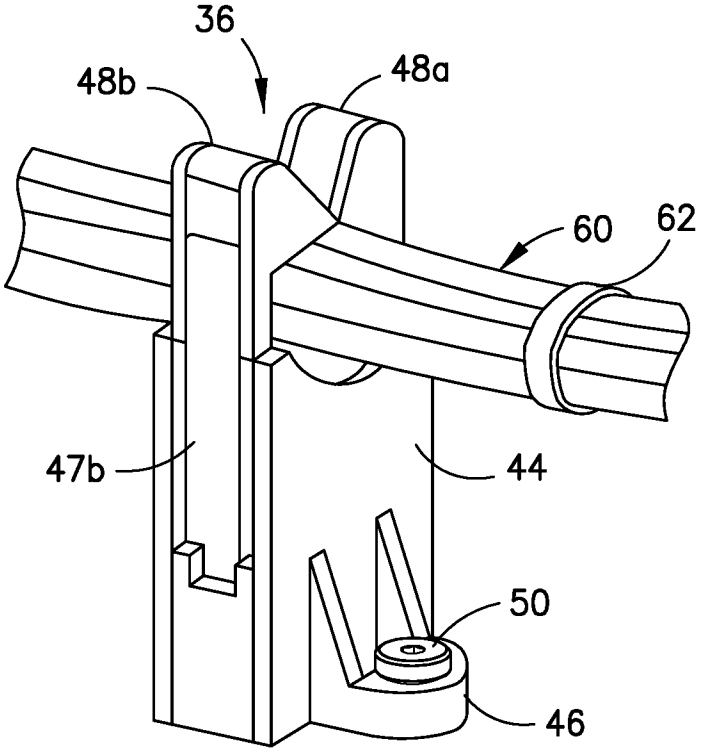
FIG. 9 is a diagram representing a three-dimensional view of a wire bundle being held by routing clip of a wire routing device of the type depicted in FIG. 3.

Still referring to FIG. 3, the routing clip 36 includes a base 44 having a pair of mounting flanges 46 (only one of which is visible in FIG. 3) fastened to the upper arm of the C-frame 32 by means of screws 50 (or other type of fasteners), a pair of flexible clip arms 47*a* and 47*b* configured to bend resiliently away from each other, and a pair of hooks 48*a* and 48*b* respectively connected to or integrally formed with the upper ends of the flexible clip arms 48*a* and 48*b* and in contact when the routing clip 36 is closed. The routing clip 36 may be opened to receive one or more wires by pushing down on the outer inclined surfaces of the hooks 48*a* and 48*b*, thereby causing the flexible clip arms 47*a* and 47*b* to bend outward and away from each other. The wires may then pass through the gap formed between the hooks 48*a* and 48*b*. The stressed flexible clip arms 47*a* and 47*b* bend inward when the force causing them to bend outward is removed. The routing clip 36 forms a cable bundle as the wires are inserted and gathered. FIG. 9 is a diagram representing a three-dimensional view of a wire bundle 60 being held by the routing clip 36. The wire bundle 60 consists of a multiplicity of wires surrounded by a plastic tie 62. The plastic tie 62 is attached following completion of the wire routing process. A complete bundle can be easily removed from the routing clip 36 by lifting the wire bundle upward, causing the wire bundle to bear against the inner inclined surfaces of the hooks 48*a* and 48*b*, thereby again causing the flexible clip arms 47*a* and 47*b* to bend outward and away from each other.

The wire routing device 12 depicted in FIG. 3 may be placed on the form board 2 by a pick-and-place end effector (not shown in the drawings). The pick-and-place end effector picks up the wire routing device 12 at one location and then carries wire routing device 12 to a position above a target location (including a target position and a target orientation) on a form board. Then the pick-and-place end effector of the robot depresses the plunger 40 into the housing 38, causing the distal ends of locking pins 42 to extend further away from the housing 38 and beyond the spacer. As the locking pins 42 are extended beyond the spacer, the locking pins 42 come together at their distal ends. The locking pins 42 can then be inserted into the hole in the perforated plate of the form board 2 that is nearest to the target position.

Figure 4:
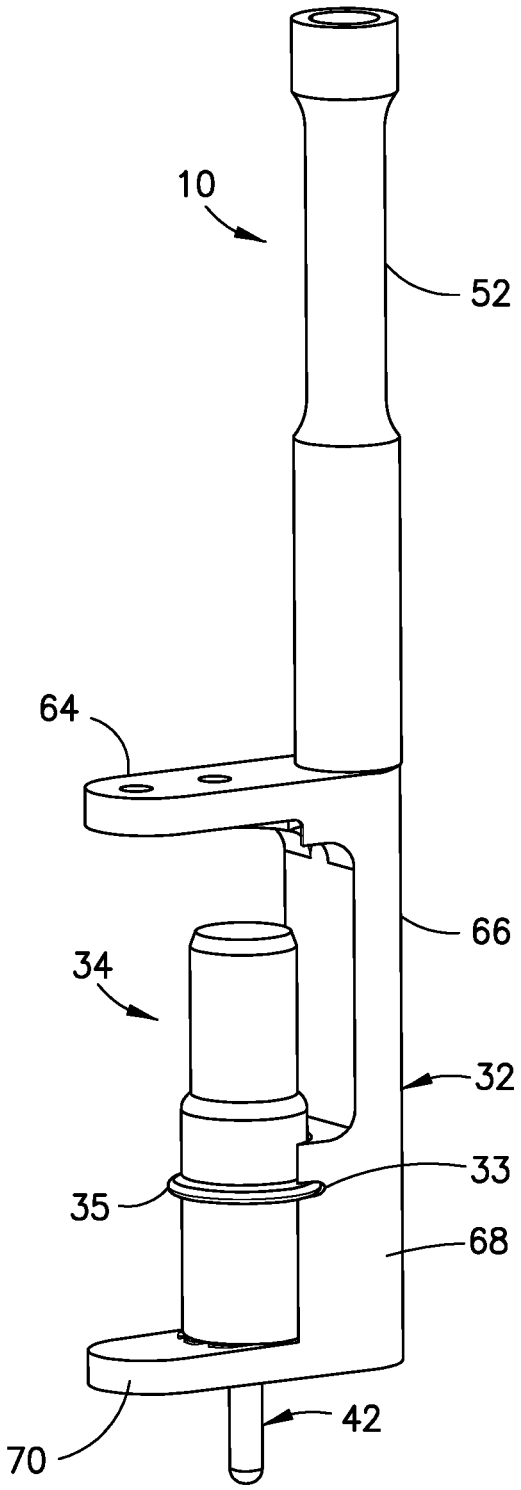
FIG. 4 is a diagram representing a three-dimensional view of a wire routing device that includes a C-frame, a temporary fastener, and a single post in accordance with one embodiment.

FIG. 4 is a diagram representing a three-dimensional view of a single-post wire routing device 10 in accordance with one embodiment. The single-post wire routing device 10 includes a C-frame 32, a temporary fastener 34 mounted to the lower arm 70 of the C-frame 32, and a post 52 having one end fastened to the C-frame 32 and extending vertically upward. In the example shown in FIG. 4, the post 52 has a circular cross section along its entire length with a varying diameter. The single-post wire routing device 10 may be located on a form board at a position where the planned wire bundle configuration calls for one or more wires to bend, thus changing direction. Multiple single-post wire routing devices 10 may be placed at regular angular intervals along an arc to be followed by a curved segment of the wire being routed.

Figure 5:
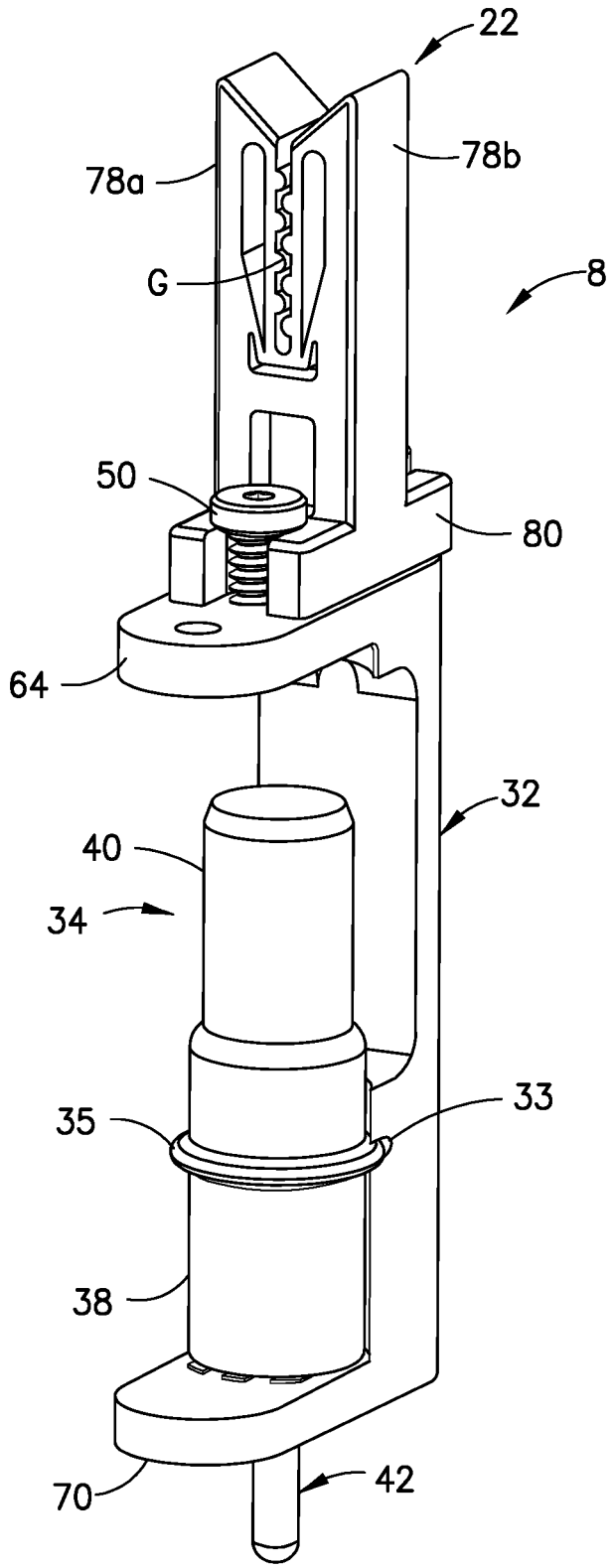
FIG. 5 is a diagram representing a three-dimensional view of a wire end holder that includes a C-frame, a temporary fastener, and a wire clip in accordance with one embodiment.

FIG. 5 is a diagram representing a three-dimensional view of a wire end holding device 8 that includes a C-frame 32, a temporary fastener 34 mounted to the lower arm 70 of the C-frame 32, and a wire clip 22 fastened to the upper arm 64 of the C-frame 32. The respective structures and respective functions of the C-frame 32 and temporary fastener 34 have been described above with reference to FIGS. 3 and 4. The wire clip 22 includes a base 80 which is fastened to the upper arm 64 of the C-frame 32 by a pair of screws 50 (only one screw 50 is fully visible in FIG. 5). The wire clip 22 further includes a pair of prongs 78*a* and 78*b* having mutually confronting surfaces which form a gap G. When the end(s) of one or more wires is inserted into the gap G while the wire end holding device 8 is temporarily fastened to a form board 2, the prongs 78*a* and 78*b* will maintain the position of the ends of the wires. Many commercially available off-the-shelf options are available. For example, wire end holding device 8 may include a wire clip commercially available from Panduit Corp., Tinley Park, Ill. The material of prongs 78*a* and 78*b* should be sufficiently resilient to allow the wire-routing end effector 14 (seen, e.g., in FIG. 6A) to push a wire into the wire clip 22.

Figure 6A:
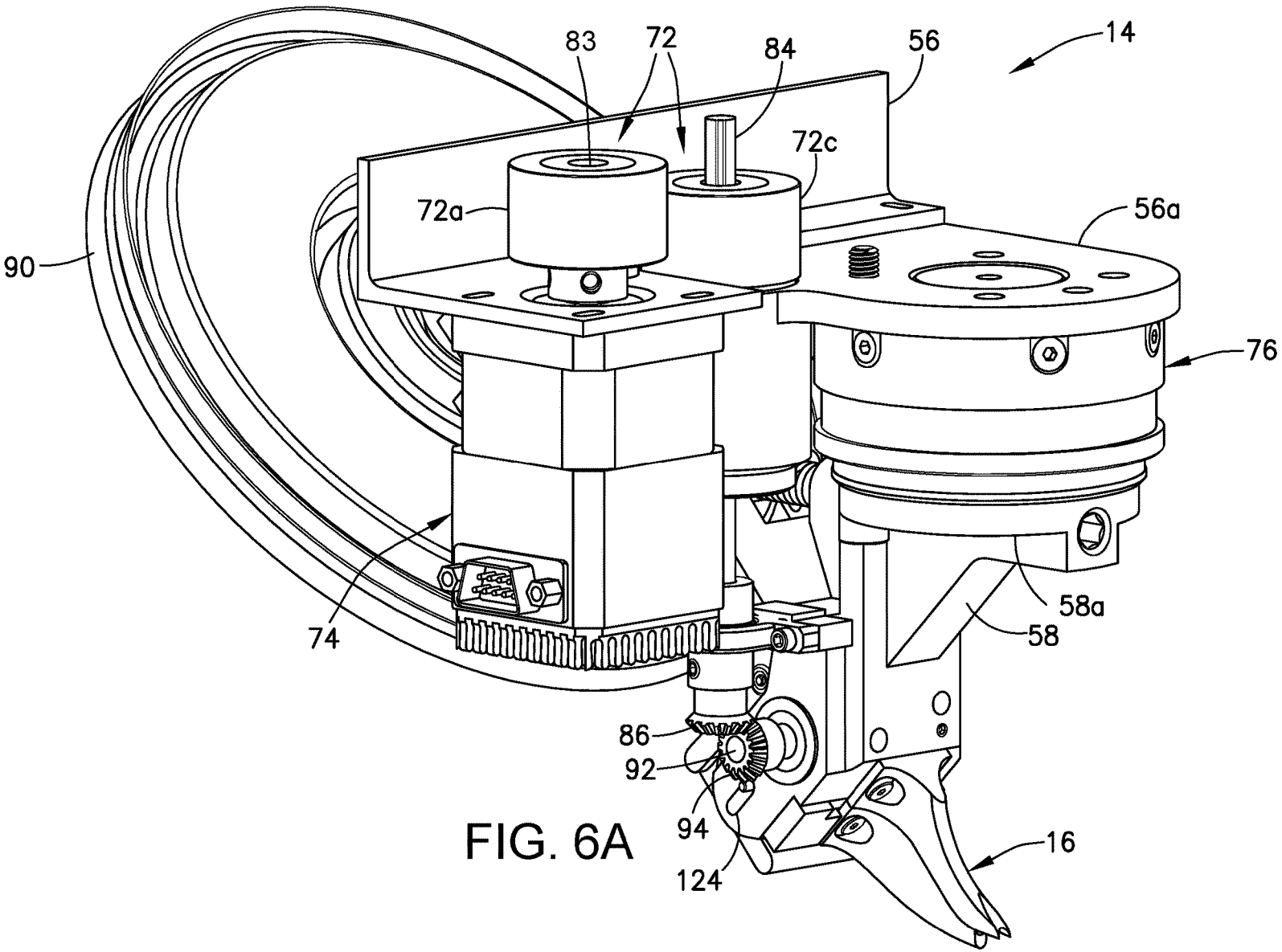
FIGS. 6A and 6B are diagrams representing respective three-dimensional views of a powered wire-routing end effector in accordance with one embodiment.
Figure 6B:
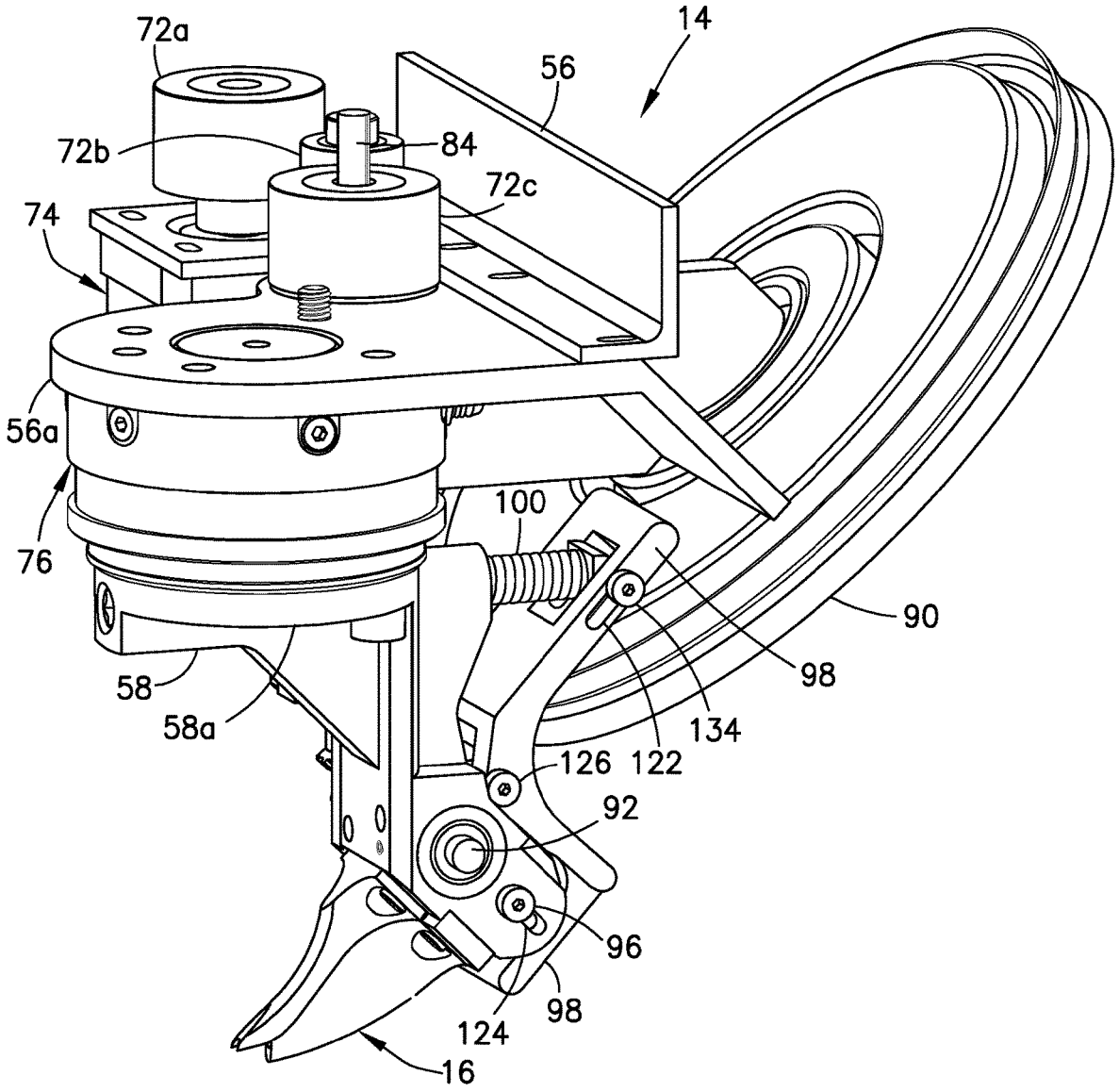

In accordance with some embodiments, after the contact at the end of a wire has been inserted into the first-end connector 20 depicted in FIG. 1, the remainder of the wire is routed through the form board devices 4 using a robotic system. FIGS. 6A and 6B are diagrams representing respective three-dimensional views of a powered wire-routing end effector 14 (hereinafter "wire-routing end effector 14") in accordance with one embodiment. The wire-routing end effector 14 has an upper frame 56 and a lower frame 58. The upper frame 56 may be rotatably coupled to the distal end of a manipulator arm of a robotic system. A reelette 90 containing a single wire is rotatably coupled to the upper frame 56. A portion of the wire is pulled out of the reelette 90 and then threaded through a routing beak 16 until a contact on the end of the wire is forward of the tip of the routing beak 16.

The wire-routing end effector 14 depicted in FIGS. 6A and 6B further includes a force/torque sensor 76 (e.g., a six-axis force/torque sensor) that is fastened to a horizontal portion 56*a* of upper frame 56. A horizontal portion 58*a* of the lower frame 58 is in turn fastened to the bottom of the force/torque sensor 76. The force/torque sensor 76 is configured to output signals representing sensor data indicating the forces and torques being exerted on the lower frame 58 due to tensioning of a wire being dispensed by the wire-routing end effector 14. The wire (not shown in FIGS. 6A and 6B is dispensed through a channel inside a routing beak 16 that is fastened to the lower frame 58. The force/torque sensor 76 measures wire tension during routing. The sensor data is sent to a robot controller (not shown in FIGS. 6A and 6B) that is configured (e.g., programmed) to control wire tension and/or detect wire snags or end effector collisions during routing.

In the embodiment depicted in FIGS. 6A and 6B, the force/torque sensor 76 is calibrated to offset the center-of-gravity of the portion of the wire-routing end effector 14 which is suspended from the force/torque sensor 76. The remaining net forces monitored by the force/torque sensor 76 are then primarily wire tension as a wire is dispensed. Forces measured are used as movement (rate) compensation of the end effector, keeping dispensed wire tension within acceptable range(s). In accordance with an alternative embodiment, the upper frame 56 may be eliminated and the reelette 90 may be rotatably coupled to the lower frame 58, in which case the force/torque sensor 76 is rotatably coupled to the distal end of the manipulator arm.

The wire-routing end effector 14 further includes a pair of wire-displacing rollers (e.g., a drive roller and an idle guide roller) designed to push and pull a wire through the routing beak 16 which dispenses the wire. In accordance with one proposed implementation, the pair of wire-displacing rollers each have outer peripheral contact surfaces made of compliant material which contact each other to form a nip. The drive roller (not visible in FIGS. 6A and 6B, but see drive roller 73 in FIG. 6F) is attached to a drive roller shaft 92 (best seen in FIG. 6B) made of metal. The drive roller shaft 92 is rotatably coupled to the lower frame 58 (by means of ball bearings 91*a* and 91*b* shown in FIG. 6D). The idle guide roller (also not visible in FIGS. 6A and 6B, but see idle guide roller 75 in FIG. 6F) is attached to an idle guide roller shaft 96 (best seen in FIG. 6B) made of metal. The rotation of the drive roller shaft 92 is powered by a stepper motor 74 (best seen in FIG. 6A) which is mounted to the upper frame 56.

Some of the components of the drive train that operatively couple the drive roller shaft 92 to the stepper motor 74 are visible in FIG. 6A. The drive train includes a roller drive train 72 and a vertical drive shaft 84 that is operatively coupled to the stepper motor 74 by means of the roller drive train 72. As best seen in FIG. 6B, the roller drive train 72 includes a first rubber drive roller 72*a* affixed to the motor output shaft 83 of the stepper motor 74, a second rubber drive roller 72*b* (see FIG. 6B) rotatably coupled to the upper frame 56 and a third rubber drive roller 72*c* coupled to the vertical drive shaft 84. The first rubber drive roller 72*a* is affixed to motor output shaft 83 of the stepper motor 74 and rotates in tandem therewith. The second rubber drive roller 72*b* transmits the rotation of the first rubber drive roller 72*a* to the third rubber drive roller 72*c*. As will be described later with reference to FIG. 6D, the vertical drive shaft 84 rotates in tandem with the third rubber drive roller 72*c*.

The drive train that operatively couples the drive roller shaft 92 to stepper motor 74 further includes a first right-angled drive shaft gear 86 mounted to one end of the vertical drive shaft 84 and a second right-angled drive shaft gear 94 mounted to one end of the drive roller shaft 92. At all times at least some teeth of the first right-angled drive shaft gear 86 are intermeshed with some teeth of the second right-angled drive shaft gear 94, thereby converting rotation of the vertical drive shaft 84 into rotation of the drive roller shaft 92.

The vertical drive shaft 84 is operatively coupled to both the upper frame 56 and the lower frame 58. To accommodate the fact that the lower frame 58 is movable relative to the upper frame, the wire-routing end effector 14 further includes a slotted drive bearing that transmits torque from the third rubber drive roller 72*c* to the vertical drive shaft 84 while allowing the vertical drive shaft 84 to move up and down slightly (along the axis of the vertical drive shaft 84) without binding. One reason for doing this is to isolate the large, unpredictable masses of the reelette from the lower frame 56 so that the force/torque sensor 76 would be exposed to less noise.

Figure 6C:
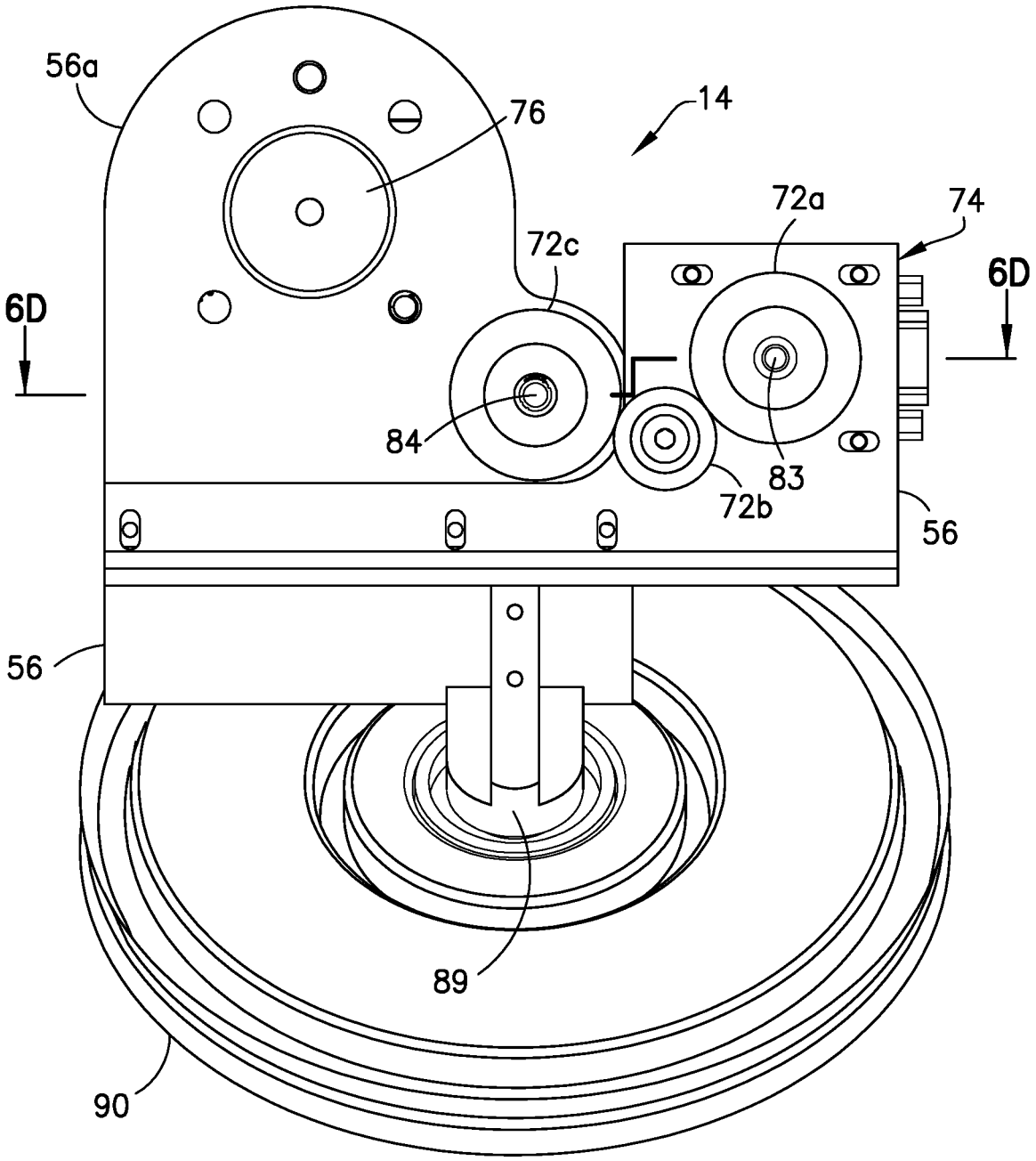
FIG. 6C is a diagram representing a top view of the powered wire-routing end effector depicted in FIGS. 6A and 6B.
Figure 6D:
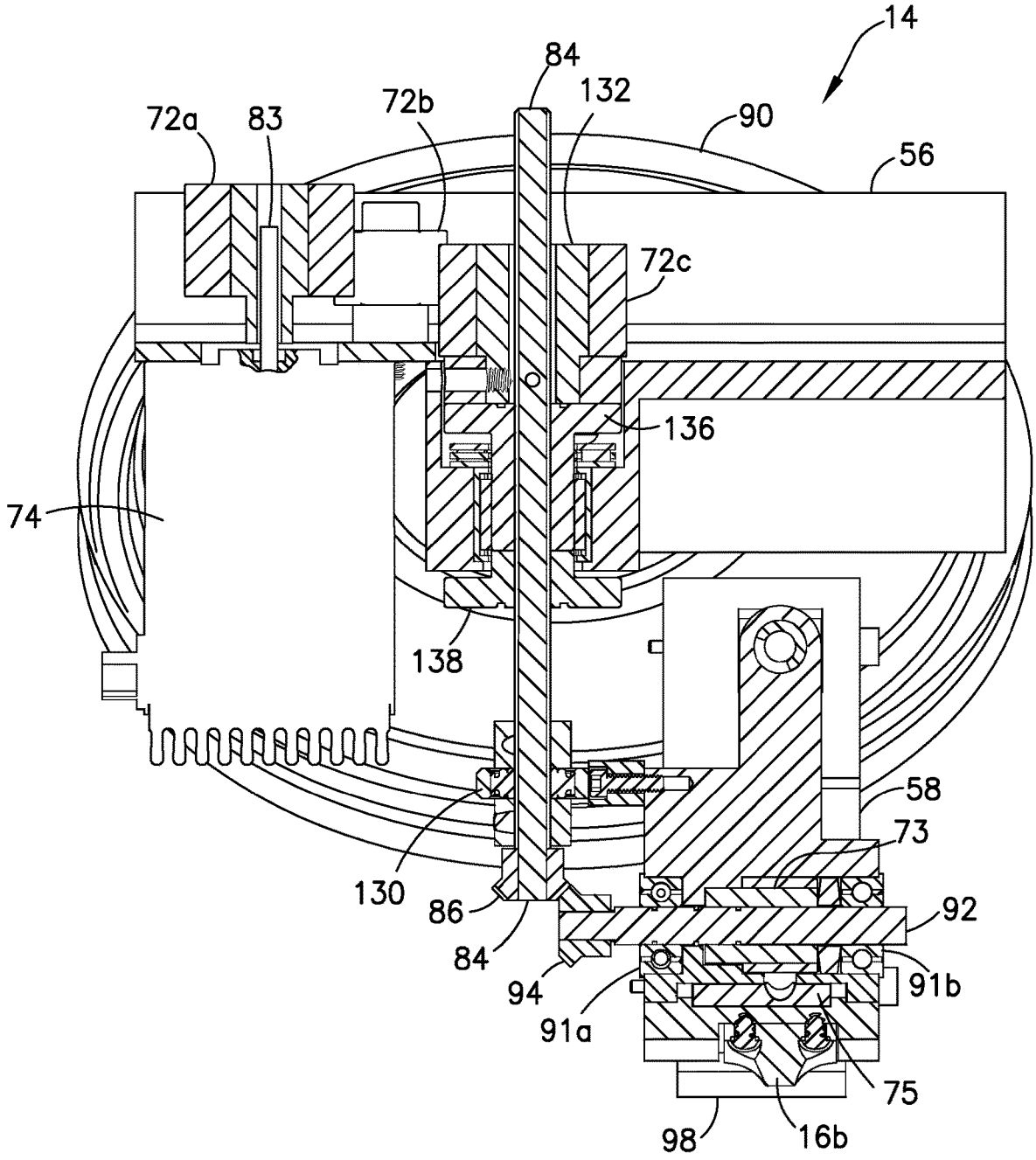
FIG. 6D is a diagram representing a sectional view of the powered wire-routing end effector depicted in FIGS. 6A and 6B, the section being taken in a plane indicated by section line 6D - - - 6D in FIG. 6C.

FIG. 6C is a diagram representing a top view of the powered wire-routing end effector 14 depicted in FIGS. 6A and 6B. FIG. 6D is a sectional view of the powered wire-routing end effector 14, the section being taken in a plane indicated by section line 6D - - - 6D in FIG. 6C. As seen in FIG. 6C, the section line passes through the axes of rotation of the vertical drive shaft 84 and the motor output shaft 83 of stepper motor 74. FIG. 6C also shows the reelette 90 attached to the upper frame 56 by means of a reelette retaining hub 89.

As best seen in FIG. 6D, the third rubber drive roller 72*c* is mounted on a bearing part 132 that is rotatably coupled to the upper frame 56. The bearing part 132 is fastened to a bearing part 136, which in turn is fastened to a bearing part 138. Thus, rotation of the bearing part 132 causes the bearing parts 136 and 138 to rotate. The bearing parts 136 and 138 are coupled to the vertical drive shaft 84 so that the vertical drive shaft 84 receives the torque produced on bearing part 132 by the rubber drive roller 72*c*. As previously described, the lower end of the vertical drive shaft 84 has a first right-angled drive shaft gear 86 affixed thereon. Thus, the first right-angled drive shaft gear 86 rotates in tandem with the rubber drive roller 72*c*. The first right-angled drive shaft gear 86 engages the second right-angled drive shaft gear 94 mounted to the drive roller shaft 92, thereby converting rotation of the vertical drive shaft 84 into rotation of the drive roller shaft 92. In summary, rotation of the motor output shaft 83 is converted into rotation of the vertical drive shaft 84, which is in turn converted into rotation of the drive roller shaft 92.

Figure 16:
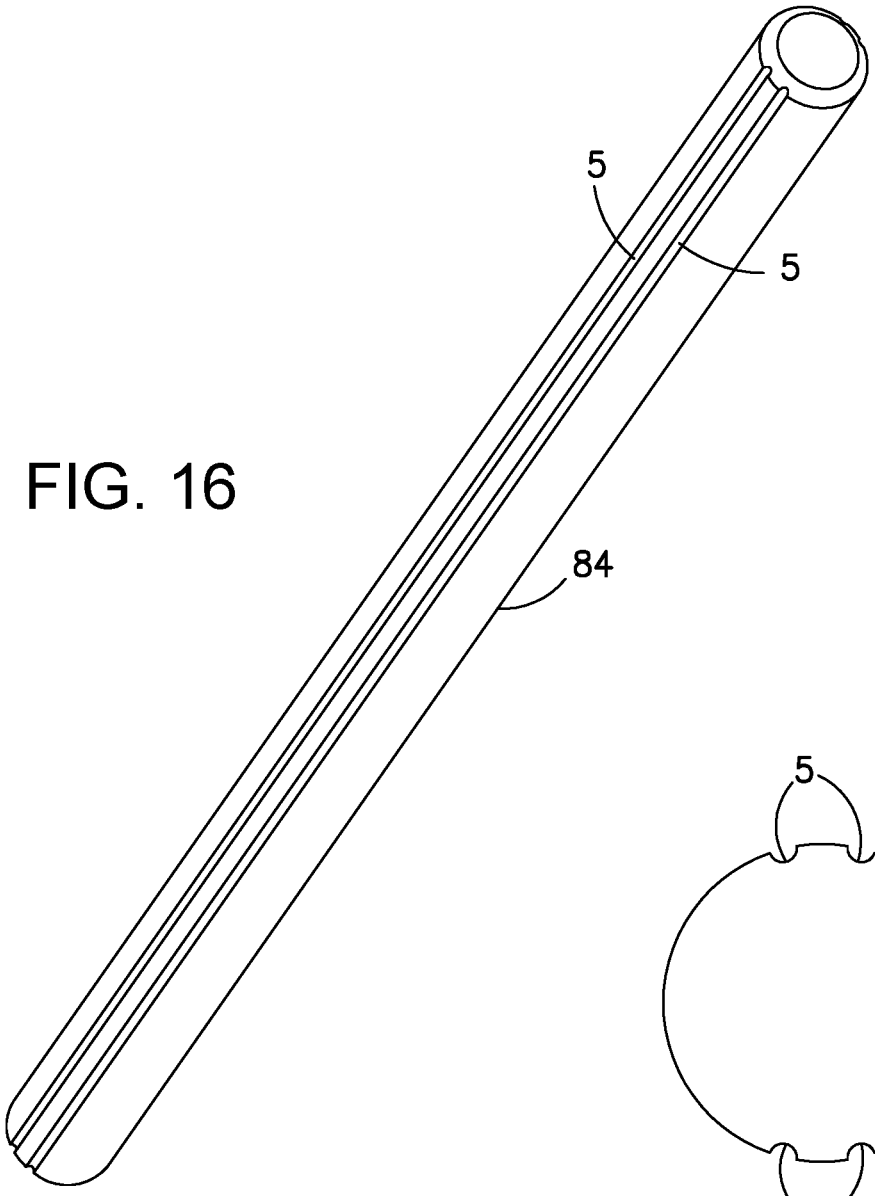
FIG. 16 is a diagram representing a three-dimensional view of a vertical drive shaft with keyslots in accordance with one embodiment.
Figure 16A:
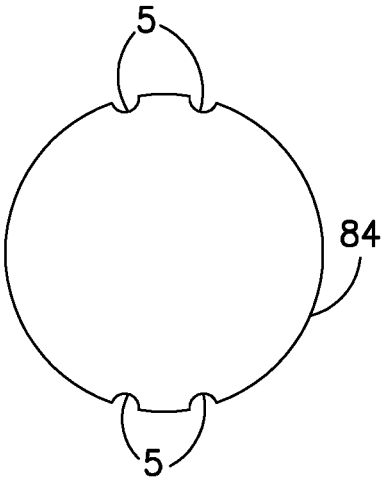
FIG. 16A is a diagram representing an end view of the vertical drive shaft depicted in FIG. 16.

FIG. 16 is a diagram representing a three-dimensional view of the vertical drive shaft 84 in isolation. FIG. 16A is a diagram representing an end view of the vertical drive shaft 84 depicted in FIG. 16. The vertical drive shaft 84 has two diametrally opposed pairs of keyslots 5 which extend the entire length of the vertical drive shaft 84. The keyslots 5 cooperate with linear projections of bearing parts 136 and 138 to allow the vertical drive shaft 84 to displace vertically relative to those bearing parts. More specifically, bearing parts 136 and 138 each have respective linear projections (not shown in the drawings) which engage the keyslots 5 formed in the vertical drive shaft 84. Sliding of those linear projections in respective keyslots 5 enables the vertical drive shaft 84 to displace vertically relative to the bearing parts 136 and 138 while receiving torque from those bearing parts. This arrangement enables torque to be transmitted while allowing more compliance in the lower portion of the end effector. This feature provides more mechanical freedom to float and to improve the accuracy of the force/torque sensor measurements.

Referring again to FIG. 6D, the lower portion of the vertical drive shaft 84 is supported by a bearing 130 that is fixedly coupled to the lower frame 58. The vertical drive shaft 84 is locked to prevent vertical displacement of the vertical drive shaft 84 relative to bearing 130 and lower frame 58. Thus, as the lower frame 58 displaces vertically relative to the upper frame 56, the vertical drive shaft 84 displaces in tandem with the lower frame 58 relative to the upper frame 56. Thus, even when the vertical drive shaft 84 is being displaced vertically relative to the upper frame 56, rotation of the vertical drive shaft 84 about a vertical axis causes the drive roller shaft 92 to rotate about a horizontal axis.

Figure 6E:
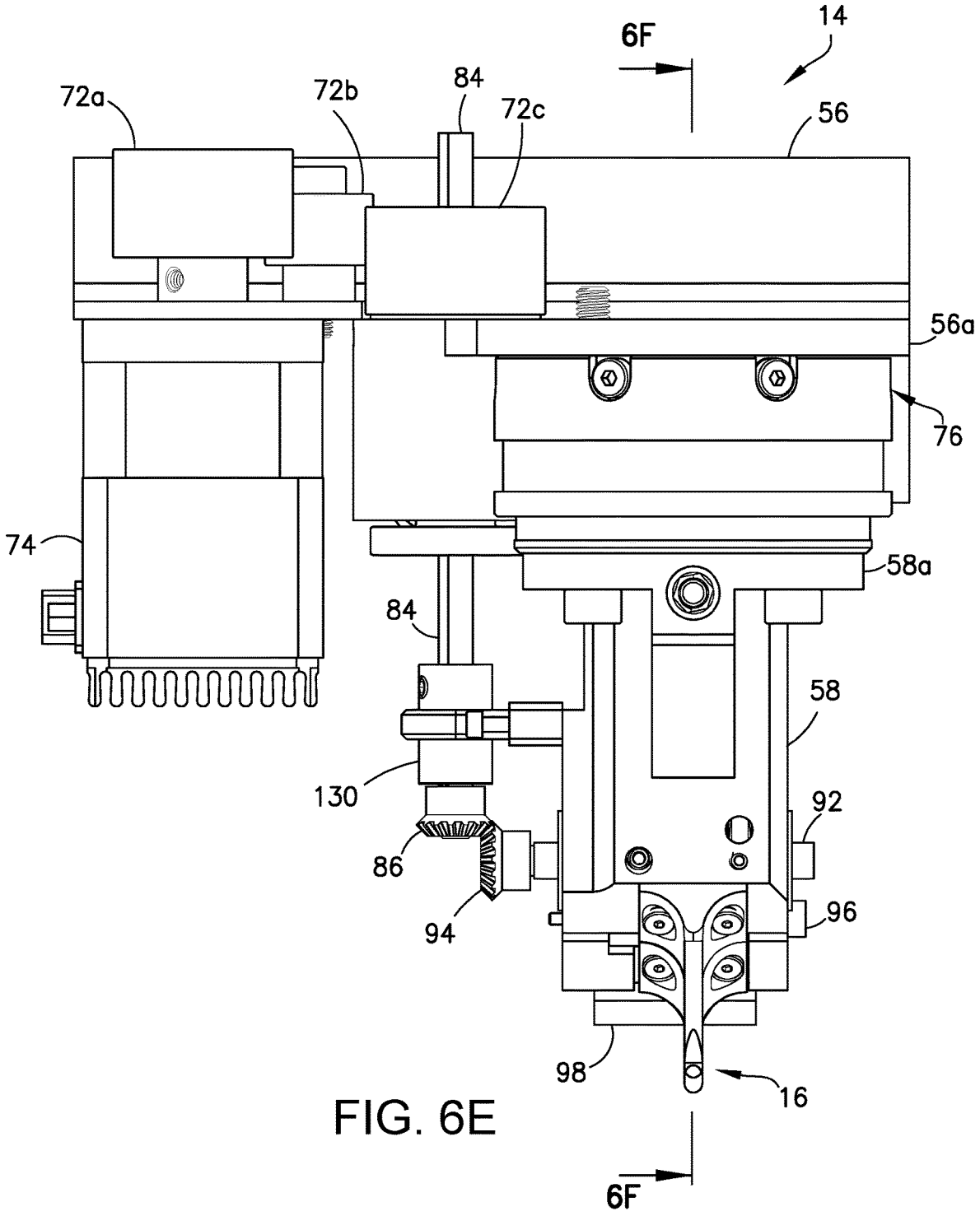
FIG. 6E is a diagram representing a side view of the powered wire-routing end effector depicted in FIGS. 6A and 6B.
Figure 6F:
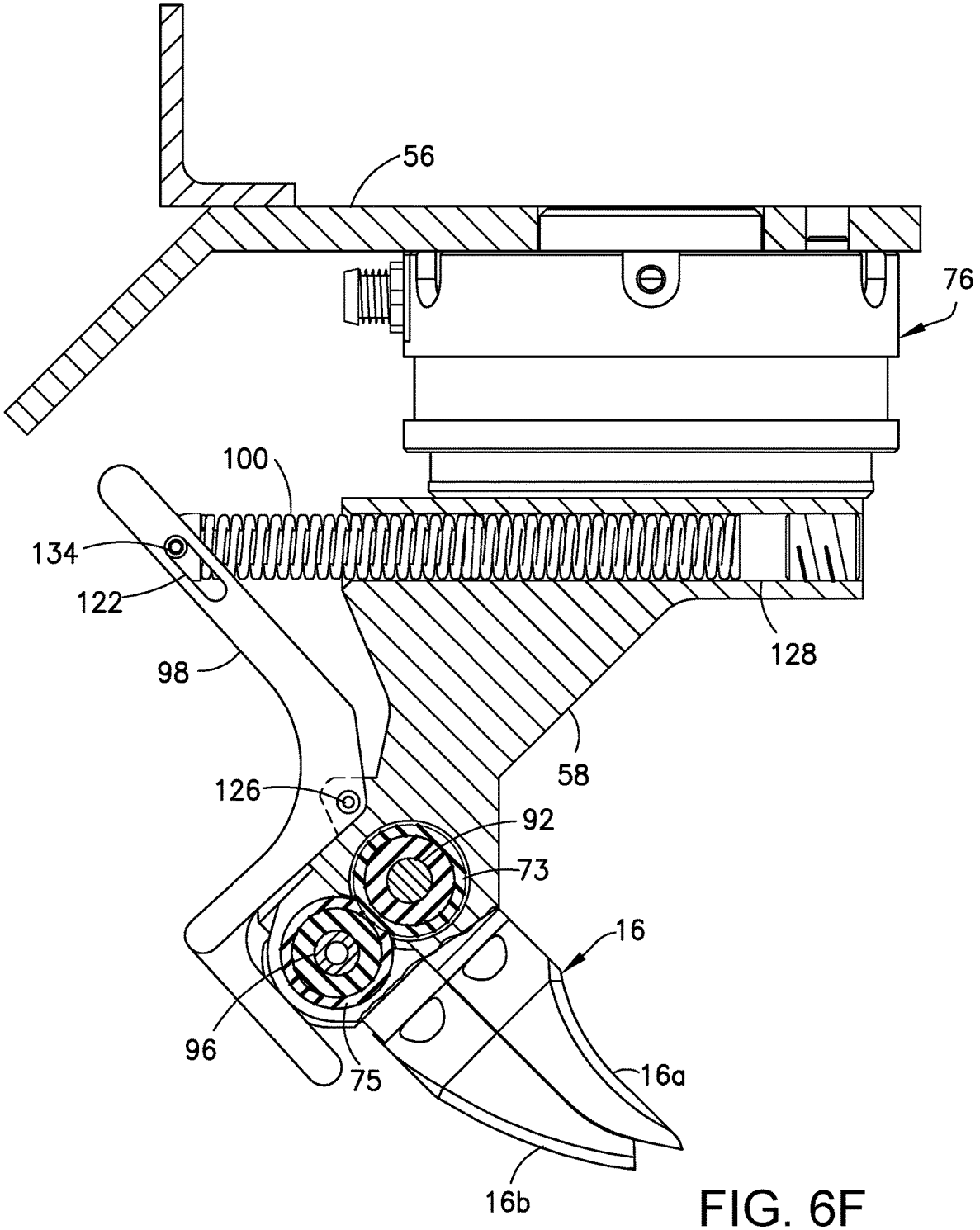
FIG. 6F is a diagram representing a sectional view of the powered wire-routing end effector depicted in FIGS. 6A and 6B, the section being taken in a plane indicated by section line 6F - - - 6F in FIG. 6E.

As best seen in FIG. 6B, the wire-routing end effector 14 further includes an idle guide spring clamp arm 98 that is rotatably coupled to the lower frame 58 by a pair of pivot pins 126, only one of which is visible in FIG. 6B (the other pivot pin 126 is visible in FIG. 6F). The idle guide roller shaft 96 is supported by and rotatably coupled to the idle guide spring clamp arm 98. As the idle guide spring clamp arm 98 rotates about the pivot pins 126, the idle guide roller shaft 96 translates toward or away from the drive roller shaft 92. The linear slots 124 constrain the motion of the ends of the idle guide roller shaft 96 during such translation. The idle guide spring clamp arm 98 pushes the idle guide roller 75 (best seen in FIG. 6F) into contact with the drive roller 73 (best seen in FIG. 6F), as explained in some detail below.

Figure 17:
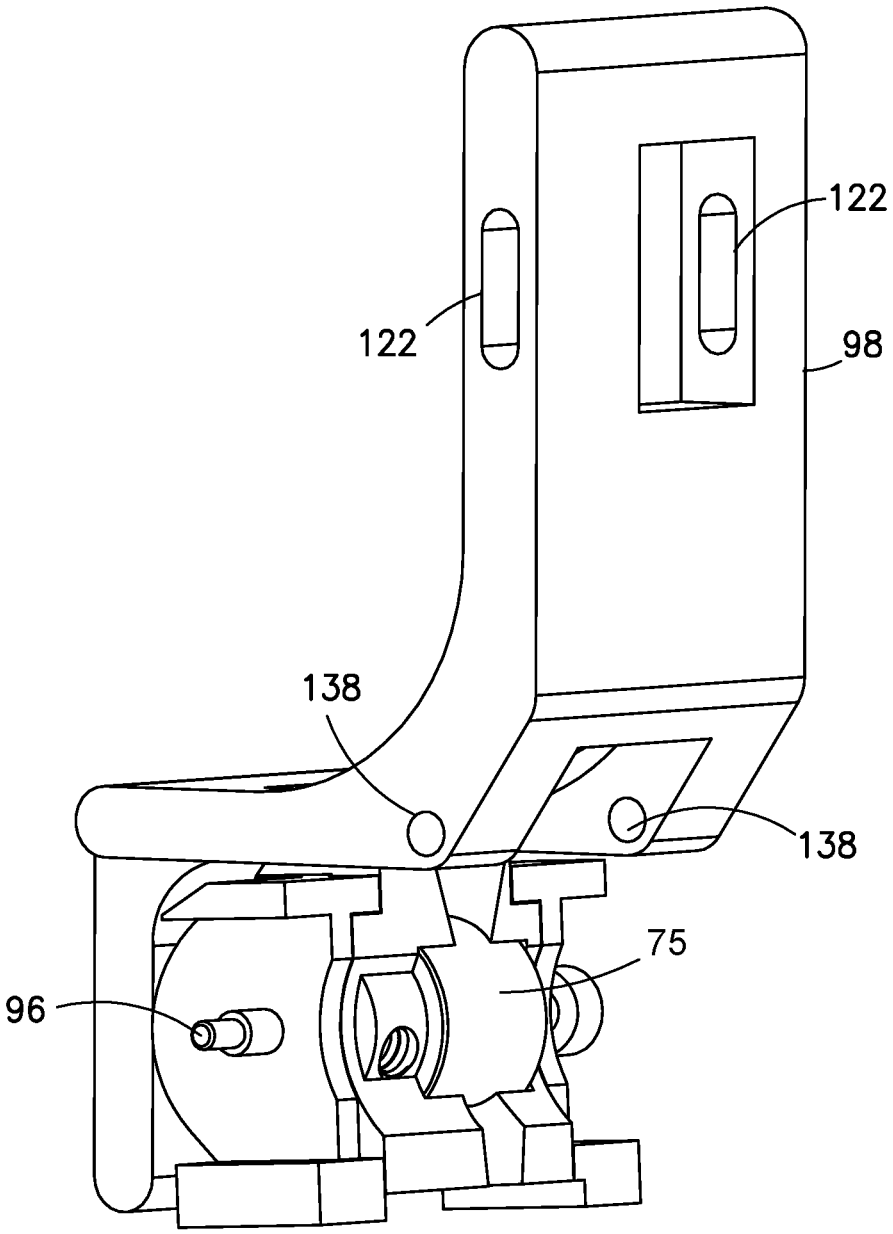
FIG. 17 is a diagram representing a three-dimensional view of a subassembly that includes an idle guide roller rotatably coupled to an idle guide spring clamp arm in accordance with one embodiment.

FIG. 17 is a diagram representing a three-dimensional view of a subassembly that includes an idle guide roller 75 rotatably coupled to an idle guide spring clamp arm 98 in accordance with one embodiment. The idle guide spring clamp arm 98 has a pair of aligned bores 142 that receive the pivot pins 126 that enable the idle guide spring clamp arm 98 to pivot relative to the lower frame in a direction that presses the idle guide roller 75 against the drive roller 73. Sufficient pressure is exerted that a wire in the nip between drive roller 73 and idle guide roller 75 will be pushed toward or away from the routing beak 16 depending on the direction in which the drive roller 73 is rotated.

FIG. 6E is a diagram representing a side view of the powered wire-routing end effector 14 depicted in FIGS. 6A and 6B. FIG. 6F is a diagram representing a sectional view of the powered wire-routing end effector 14 depicted in FIGS. 6A and 6B, the section being taken in a plane indicated by section line 6F - - - 6F in FIG. 6E. As best seen in FIG. 6F, the powered wire-routing end effector 14 further includes a compression spring 100 which is seated in a bore 128 formed in the lower frame 58. One end of the compression spring 100 is coupled to an upper portion of the idle guide spring clamp arm 98 by means of a pair of pins 134 (only one of which is visible in FIG. 6F). The pins 134 project in opposite directions from the end of the compression spring 100 and into a corresponding pair of linear slots 122 formed in the idle guide spring clamp arm 98. When the pins 134 are disposed at the upper ends of linear slots 122, the compression spring 100 urges the idle guide spring clamp arm 98 to rotate in a direction that presses the idle guide roller 75 against the drive roller 73.

The idle guide spring clamp arm 98 is an adjustable spring lever-arm to set and maintain appropriate force for idle guide roller-to-drive roller interference. Its primary function is to prevent slipping between the drive roller 73 and wire(s) of various gauges, cross sections, and jacket surface frictions. In accordance with the embodiment of the powered wire-routing end effector 14 depicted in FIGS. 6A-6F, the force exerted may be adjusted manually. In alternative embodiments, the force adjustment mechanism may be automated by means of a servo-powered hex tool that would adapt spring preload according to the specific wire being loaded. The shape of the idle guide spring clamp arm 98 is primarily configured to maximize operating clearance below the powered wire-routing end effector 14, while still allowing the wire to pass through and between the drive roller 73 and the idle guide roller 75.

The drive roller 73 and idle guide roller 75 each have outer peripheral contact surfaces made of compliant material (e.g., rubber). When the compression spring 100 pushes the idle guide roller 75 into contact with the drive roller 73, the compliant surfaces form a nip with sufficient friction that the idle guide roller 75 will rotate as the drive roller 73 rotates. The drive roller shaft 92 is capable of bidirectional rotation. When a wire is present in the nip, the portion of the wire in the nip is pushed toward the routing beak 16 during rotation of the drive roller shaft 92 in a first direction. Alternatively, the portion of the wire in the nip is pulled away from the routing beak 16 during rotation of the drive roller shaft 92 in a second direction opposite to the first direction.

Optionally, the wire-routing end effector 14 may be provided with a rotary encoder not shown in FIGS. 6A-6F) that is coupled to the drive roller. The rotary encoder is configured to convert each incremental rotation of the drive roller 73 into a signal representing encoder data indicating a direction of each incremental rotation of the drive roller 73. In alternative embodiments, the rotary encoder may be coupled to the vertical drive shaft 84 or encoder data may be generated by the stepper motor 74. The encoder data is stored in a non-transitory tangible computer-readable storage medium. A computer may be programmed to calculate the wire length based on the stored encoder data. Thus, assuming that there is no slippage between the wire in the nip and the drive roller 73, the length of wire dispensed during a routing operation may be measured.

The stored encoder data may be used to calculate the length of wire which has been dispensed during any interval of time. For example, the encoder data may be used to calculate the total length of wire that was dispensed as the TCP of the robotic system traveled along a routing path from a routing start point to a routing end point. This measurement may also be used to calculate the actual length of a wire that extends from the first-end connector to a known second-end cut location. The measured lengths are recorded in a database for each wire in a harness. The amount of waste produced during assembly of future wire bundles may be better optimized when the individual wire lengths are logged, evaluated, and corrected over time. For example, successive wires routed along the same routing path may increase in length overall as each wire conforms to the accumulated total bundle previously routed.

Figure 7:
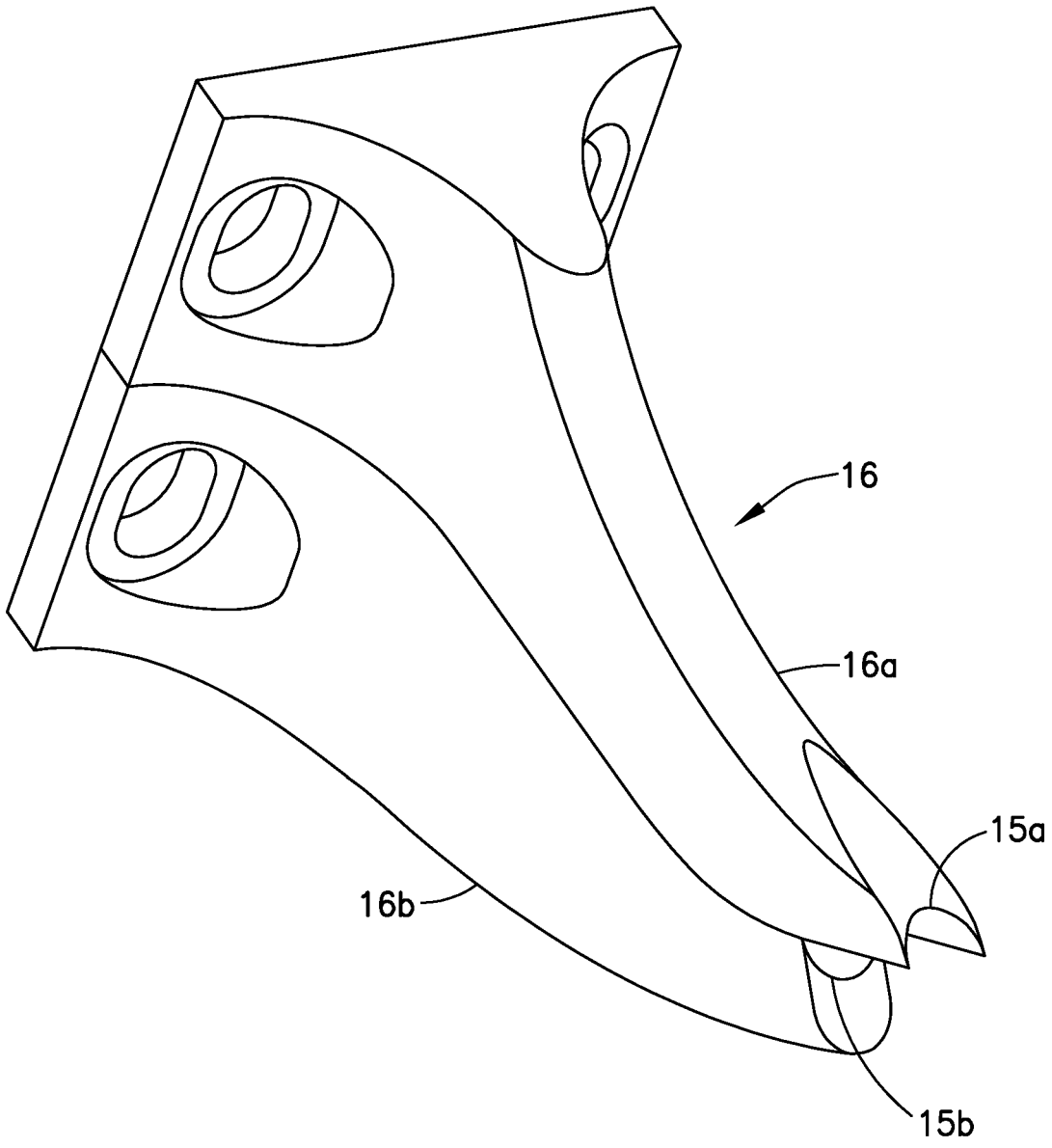
FIG. 7 is a diagram representing a three-dimensional view of a wire-dispensing beak of the wire-routing end effector depicted in FIGS. 6A and 6B.

FIG. 7 is a diagram representing a three-dimensional view of the routing beak 16 of the wire-routing end effector depicted in FIGS. 6A-6F. The routing beak 16 is attached to and projects from the lower frame 58. In accordance with the implementation depicted in FIG. 7, the routing beak 16 has a height which decreases from a point of attachment to the lower frame 58 to a tip of the routing beak 16. The routing beak 16 includes an upper beak part 16*a* having a groove 15*a* and a lower beak part 16*b* having a groove 15*b*. The grooves 15*a* and 15*b* form the channel which is configured to guide a portion of a wire that is being passed through the routing beak 16. More specifically, the channel is configured to guide the wire along a predetermined path relative to the lower frame 58 as the wire moves through the channel. The upper beak part 16*a* projects forward beyond the lower beak part 16*b*, thereby limiting upward movement of the portion of the wire positioned under the overhang. The robot controller may be programmed to treat a selected point underneath the overhang as the tool center point.

The wire-routing end effector 14 may be coupled to the distal end of a manipulator arm of a robot. The robot may include either a mobile pedestal or a gantry which carries the manipulator arm. The robot further includes a robot controller configured to control movement of the mobile pedestal or gantry relative to ground, movement of the manipulator arm relative to the mobile pedestal or gantry, and rotation of the wire-routing end effector relative to the manipulator arm. The robot controller is communicatively coupled to receive sensor data from the force/torque sensor 76. The robot controller is further configured to control movement of the manipulator arm, taking into account the sensor data received from the force/torque sensor 76. This enables the robot controller to control tension during routing. The sensor data may also be used to detect wire snags or end effector collisions during routing.

FIGS. 8A through 8L are diagrams representing three-dimensional views of a multiplicity of form board devices 4 attached to a form board 2 at respective stages during an automated wire routing operation in accordance with one embodiment. The chain lines seen in each of FIGS. 8A-8D and 8F-8I represent segments of a planned path to be traveled by the tool center point (hereinafter "TCP") of the wire-routing end effector 14 depicted in FIGS. 6A-6F. The bold solid lines seen in each of FIGS. 8C, 8D and 8F-8L (which bold solid lines replace one or more of the chain lines seen in FIG. 8A) represent segments of an actual path traveled by the TCP of the wire-routing end effector 14. The wire being routed (which wire has a contact attached to a first end) is not shown in FIGS. 8A-8L.

Figure 8A:
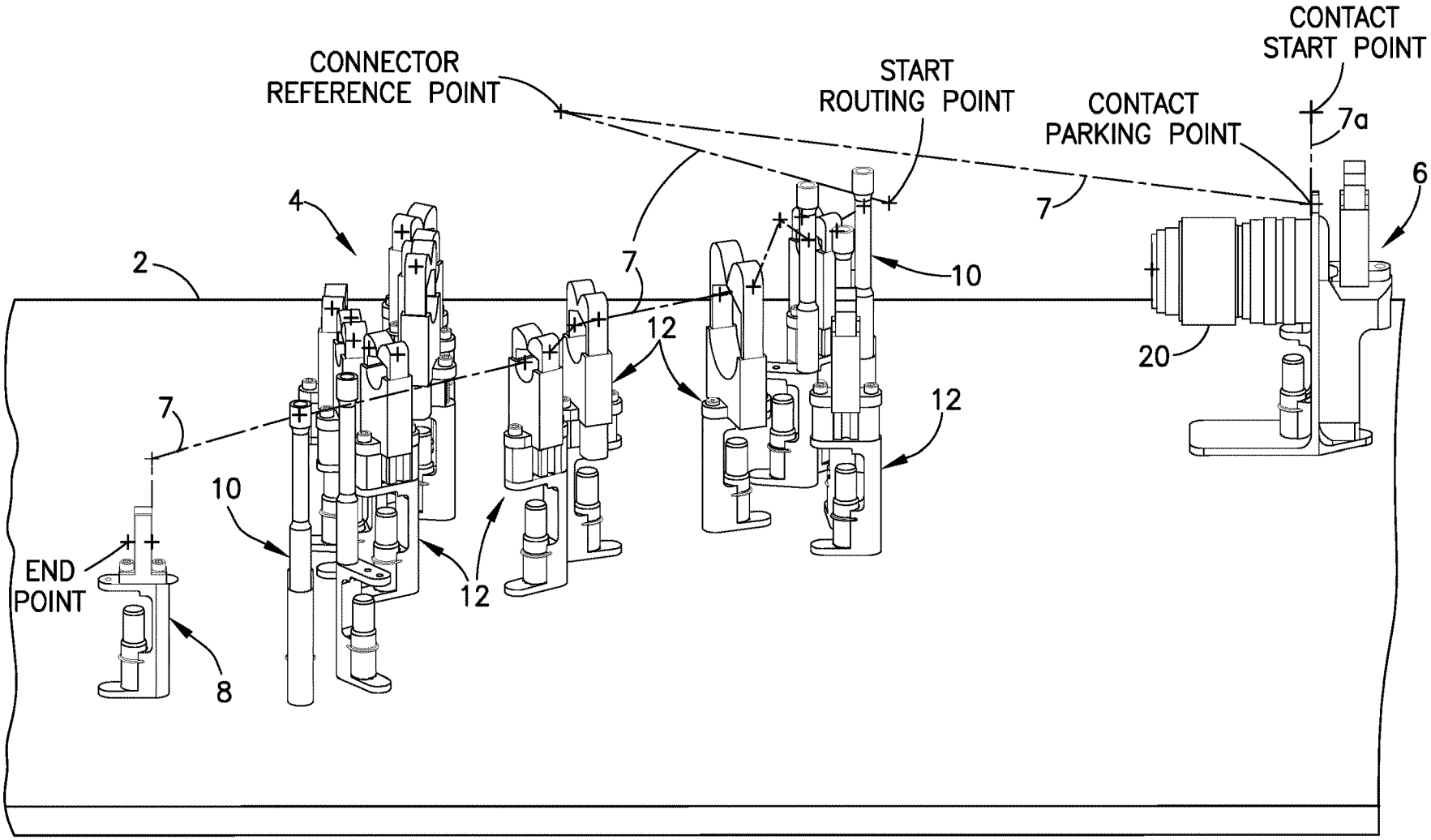
FIG. 8A through 8L are diagrams representing three-dimensional views of a multiplicity of devices attached to a form board at respective stages during an automated wire routing operation in accordance with one embodiment.

FIG. 8A is a diagram showing a three-dimensional view of an example set of form board devices 4 attached to a form board 2 in a specified configuration (hereinafter "the form board assembly depicted in FIG. 1") prior to the start of a planned wire routing process. Execution of the wire routing plan depends on controlling the TCP of wire-routing end effector 14. FIG. 8A shows a planned TCP path 7 that begins at a Contact Start Point and terminates at an End Point. First, the TCP will be moved from the Contact Start Point to the Contact Parking Point. Then the TCP will be moved from the Contact Parking Point to the Connector Reference Point. Next the TCP will be moved from the Connector Reference Point to the Start Routing Point, where wire routing will begin. Then the TCP is moved from the Start Routing Point along a non-linear path to the End Point. That non-linear path is designed to route the wire through selected form board devices 4. The planned TCP path 7 is calculated to provide collision-free routing of a wire from the first-end connector support device 6 to the wire end holding device 8. The robot motion constraints for achieving a collision-free TCP path include the following: (1) the wire-routing end effector is moved so that the TCP approaches the Contact Start Point and the End Point from above; (2) as the wire-routing end effector moves, the vertical drive shaft is maintained vertical (relative to a horizontal form board 2) at all times; (3) when the TCP is following an arc-shaped path segment (connecting two straight path segments), the wire-routing end effector is continuously rotated so that the in-line vertical plane that bisects the routing beak is maintained perpendicular to the tangent to the arc at the TCP; and (4) robot joints stay above the wire-routing end effector when in any area above the form board 2.

Figure 8B:
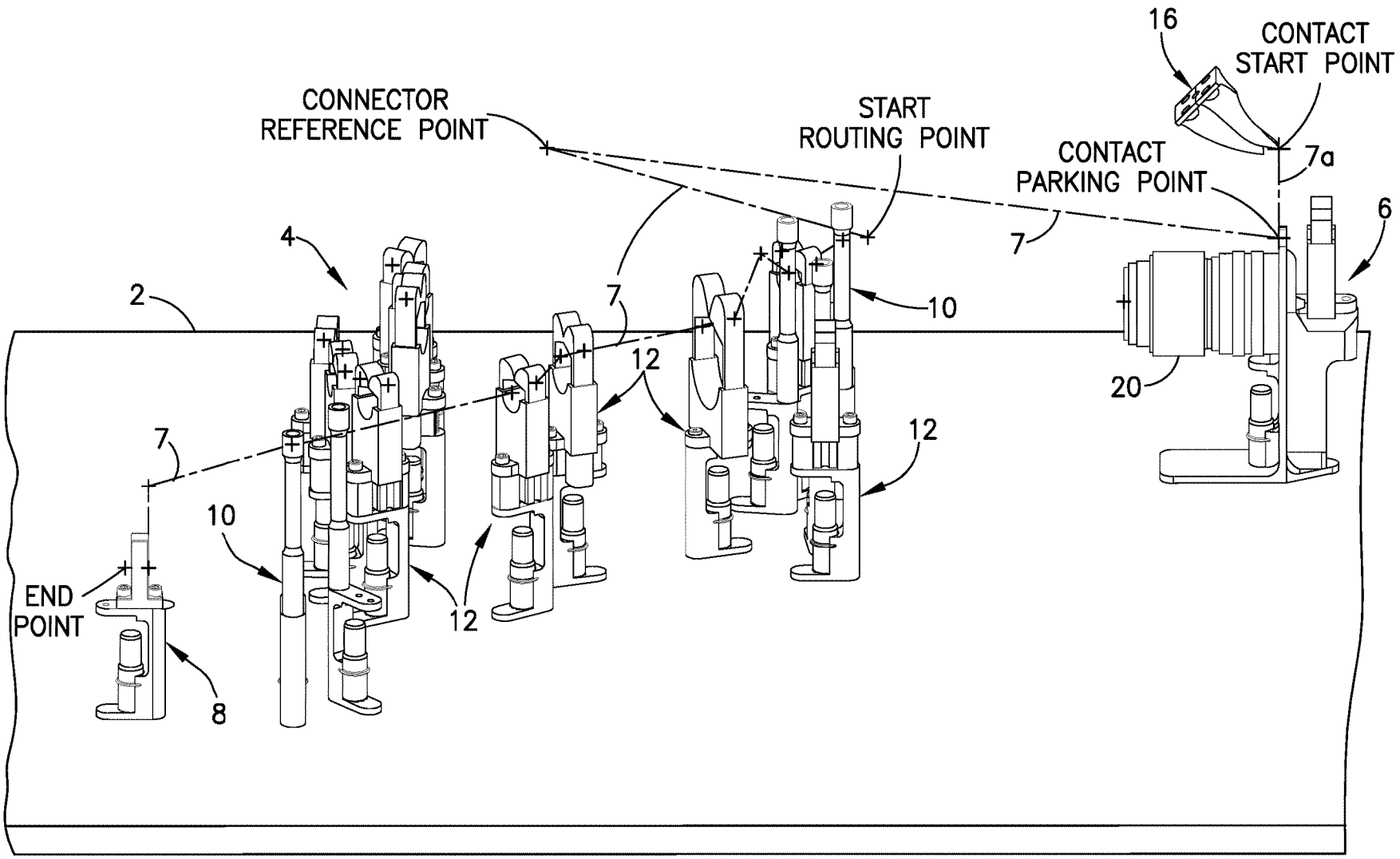

FIG. 8B is a diagram showing a three-dimensional view of the form board assembly depicted in FIG. 8A at the start of the planned wire routing process. FIG. 8B shows the location of the routing beak 16 when the TCP is at the Contact Start Point and the wire-routing end effector (not shown in FIG. 8B) is rotated toward a Connector Reference Point. As previously mentioned, the wire to be routed and the contact at the end of the wire are not shown in FIG. 8B. Were the contact to be shown, a portion of the contact would extend past the Contact Start Point.

Figure 8C:
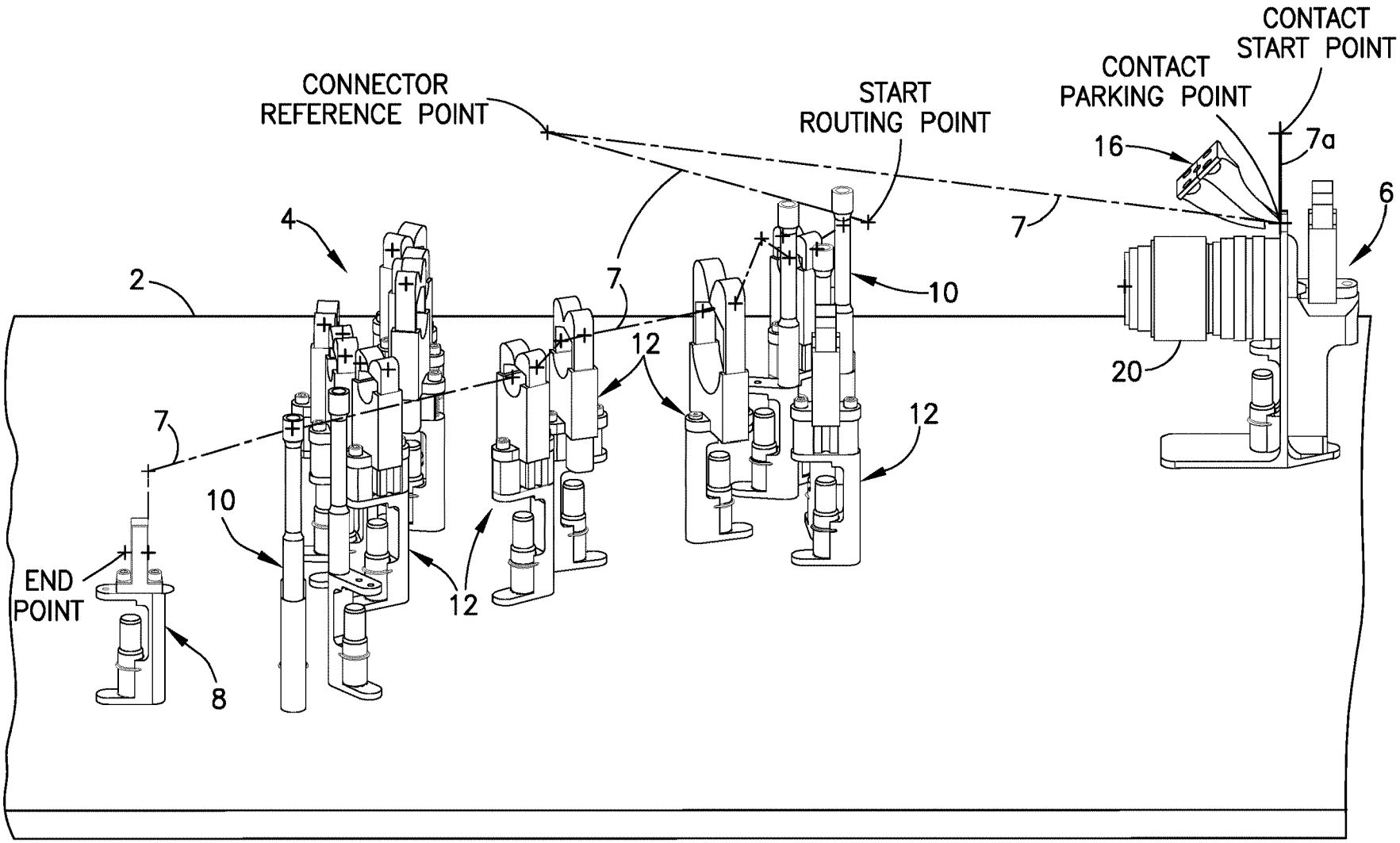

FIG. 8C is a diagram showing a three-dimensional view of the form board assembly depicted in FIG. 8B at the next stage of the planned wire routing process. FIG. 8C shows the location of the routing beak 16 after the TCP has been displaced vertically downward from the Contact Start Point to the Contact Parking Point. This downward displacement of the TCP is indicated by bold vertical line 7*a* in FIG. 8C. The downward movement places a portion of the contact 3 at the end of the wire in the notch 25 on the first-end connector support device 6 as shown in FIG. 2A. The robot controller than activates the drive roller 73 of the wire-routing end effector 14 to create sufficient tension in the wire that the locking tab or shoulder 3*b* is pulled snug against the surface 26*a* of the notched projection 26. At this juncture, the robot controller or other computer starts to record the output from the rotary encoder that measures the length of the wire being dispensed as the wire-routing end effector 14 is moved.

Figure 8D:
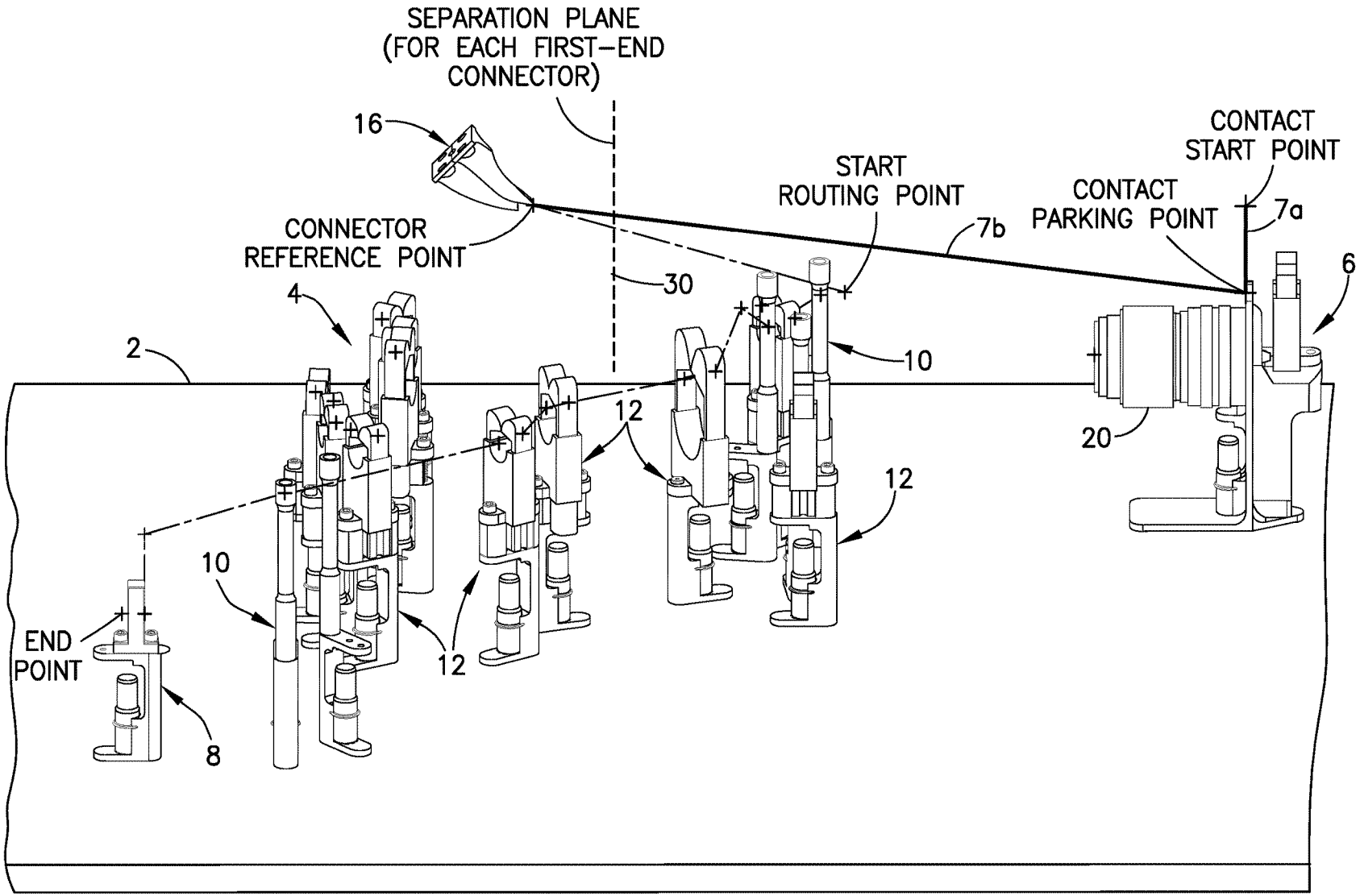

FIG. 8D is a diagram showing a three-dimensional view of the form board assembly depicted in FIG. 8C at the next stage of the planned wire routing process. FIG. 8D shows the location of the routing beak 16 after the TCP has been moved from the Contact Parking Point to the Connector Reference Point. This movement of the TCP is indicated by bold line 7*b* in FIG. 8D. The Connector Reference Point is positioned on the opposite side of a hypothetical separation plane 30 that is perpendicular to the form board 2 and at a specified distance from the end face of the first-end connector 20.

During movement of the TCP from the Contact Parking Point to the Connector Reference Point, the contact 3 remains inside the first-end connector and the wire terminated by that contact does not move in a lengthwise direction (the wire may move laterally or vertically if the routing beak 16 so moves). As the routing beak 16 travels along the wire in a direction away from the first-end connector 20, the drive roller 73 is driven to rotate in a direction that causes a length of wire to be dispensed from the wire-routing end effector 14. The frictional forces exerted on the wire by the routing beak 16 and the rollers (drive roller 73 and idle guide roller 75) produce tension in the wire. Meanwhile the force/torque sensor 76 of the wire-routing end effector 14 senses the tension in the wire and sends sensor data representing those measurements to a robot controller. The robot controller is configured (e.g., programmed) to control both movement of the wire-routing end effector 14 and the rotational speed of the drive roller 73 so that tension in the segment of wire extending from the first-end connector 20 to the drive roller 73 does not exceed a specified upper limit.

When the wire-routing end effector 14 (mounted to a first manipulator arm) is safely beyond the separation plane 30, a contact-insertion end effector 18 (mounted to a second manipulator arm) is moved so that a pair of grippers grip the wire near the contact. Then the grippers lift the gripped portion of the wire up until the contact is clear of the notch 25. Thereafter the contact-insertion end effector 18 moves to the position depicted in FIG. 8E.

Figure 8E:
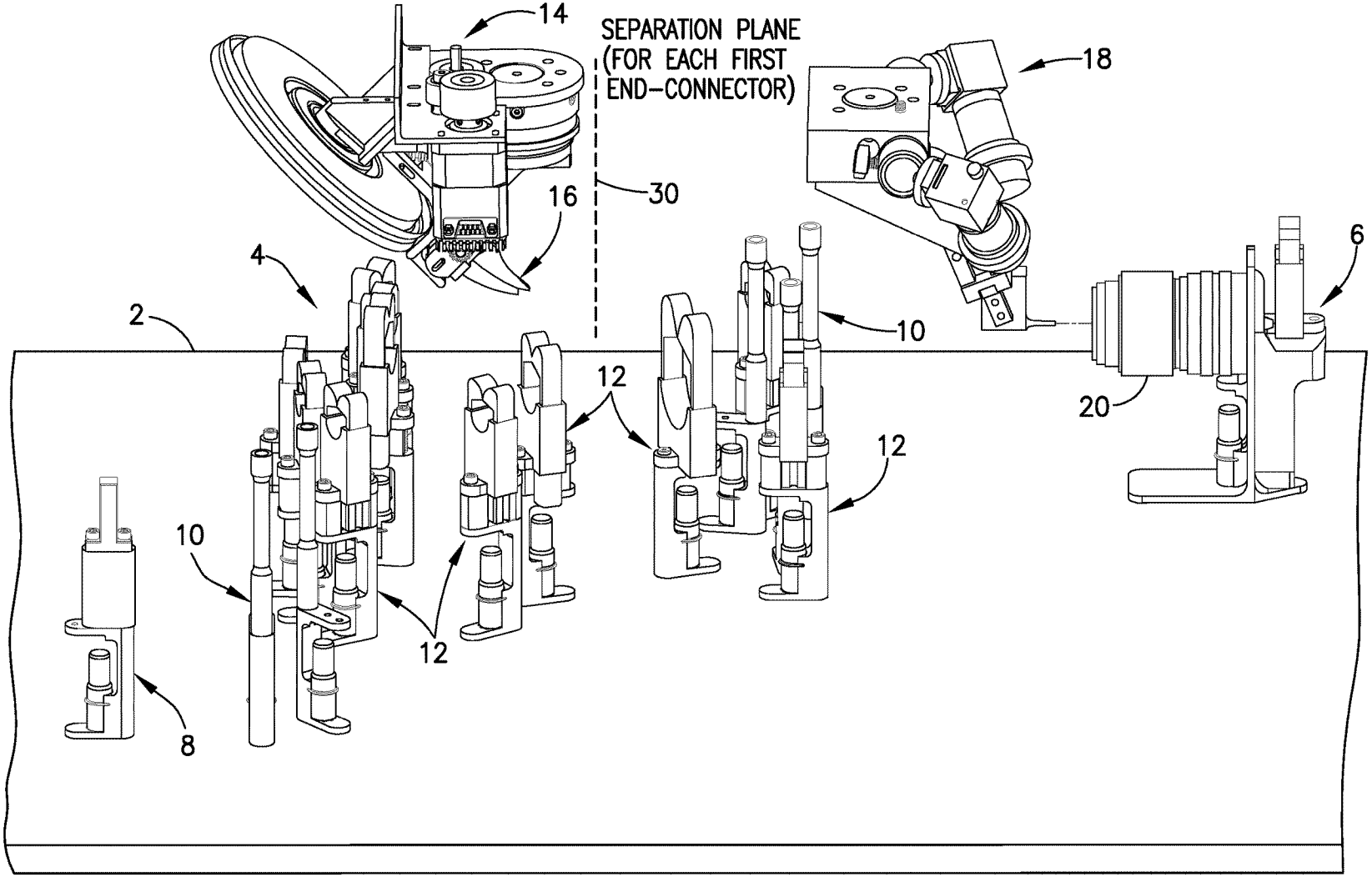

FIG. 8E is a diagram showing a three-dimensional view of the form board assembly depicted in FIG. 8D at the start of insertion of the contact into the first-end connector 20. FIG. 8E shows wire-routing end effector 14 on one side of separation plane 30 and contact-insertion end effector 18 on the other side of separation plane 30. The specified distance between separation plane 30 and the end face of the first-end connector 20 is calculated to provide sufficient clearance for a contact-insertion end effector 18 to insert a contact 3 (see FIG. 2A) into the first-end connector 20 without colliding with the parked wire-routing end effector 14. The contact-insertion end effector 18 includes mechanisms for displacing a contact insertion tip along a linear path that is collinear with the axis of the hole in which the contact 3 is to be inserted.

Figure 8F:
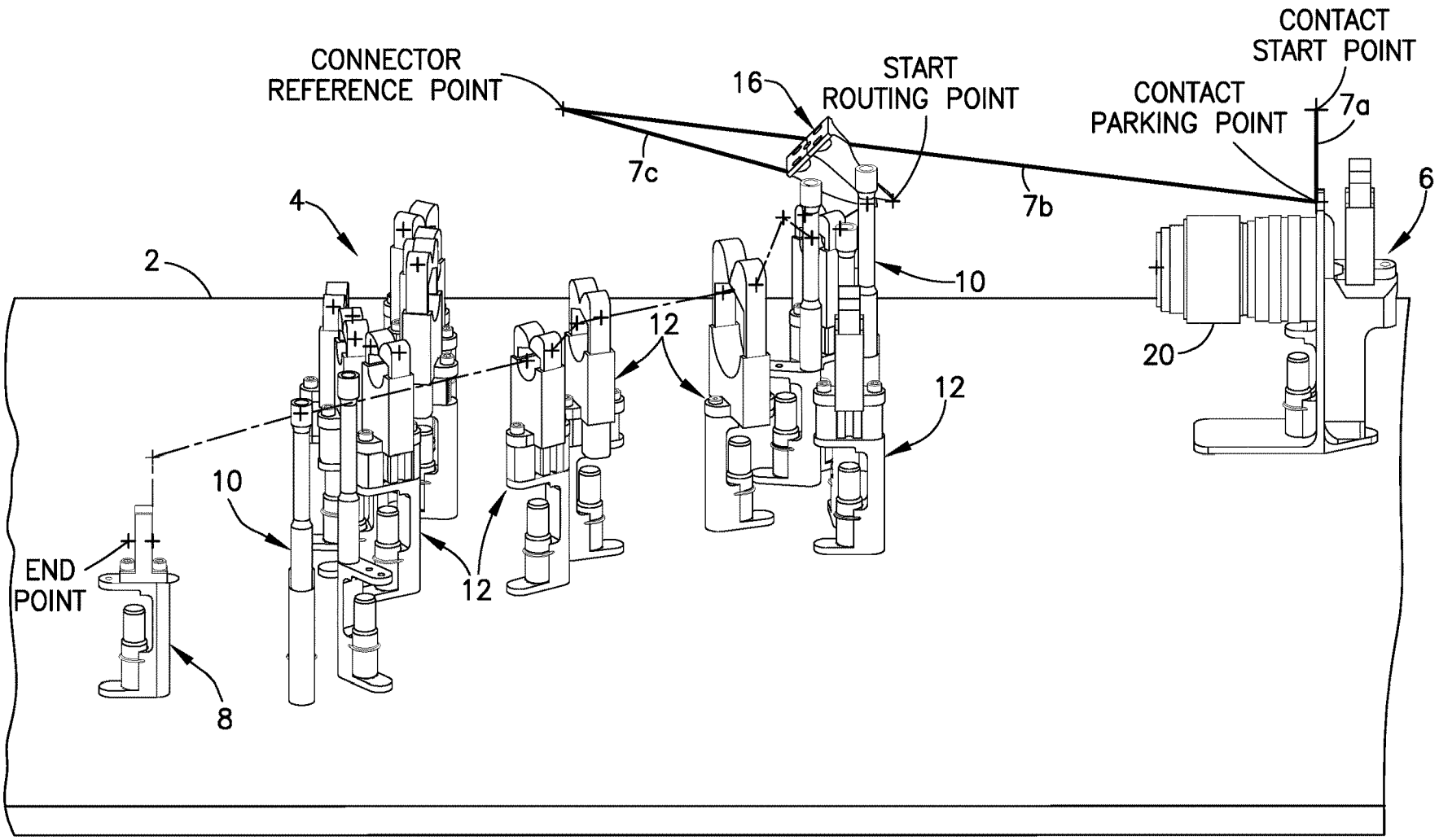
Figure 8G:
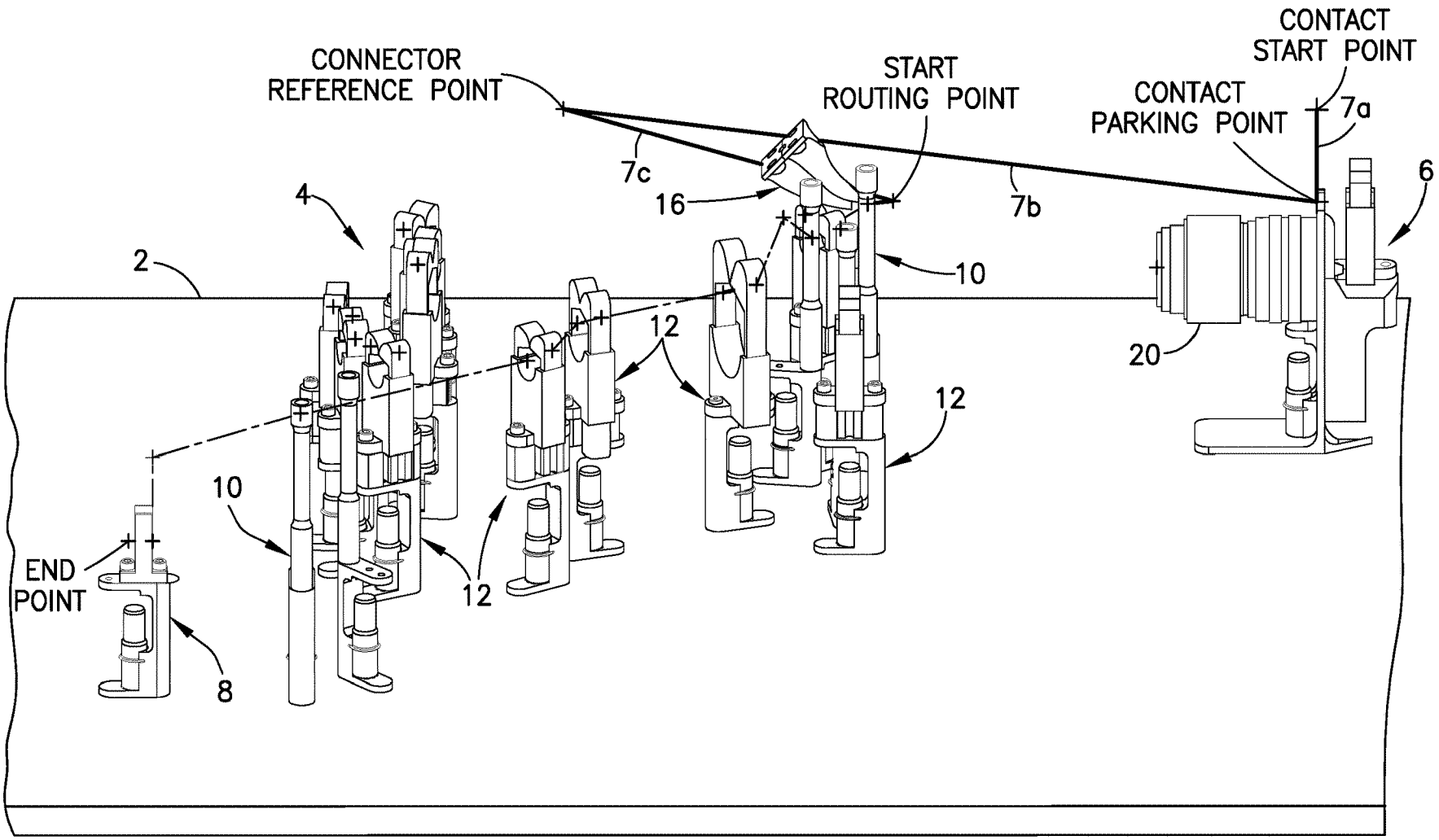
Figure 8H:
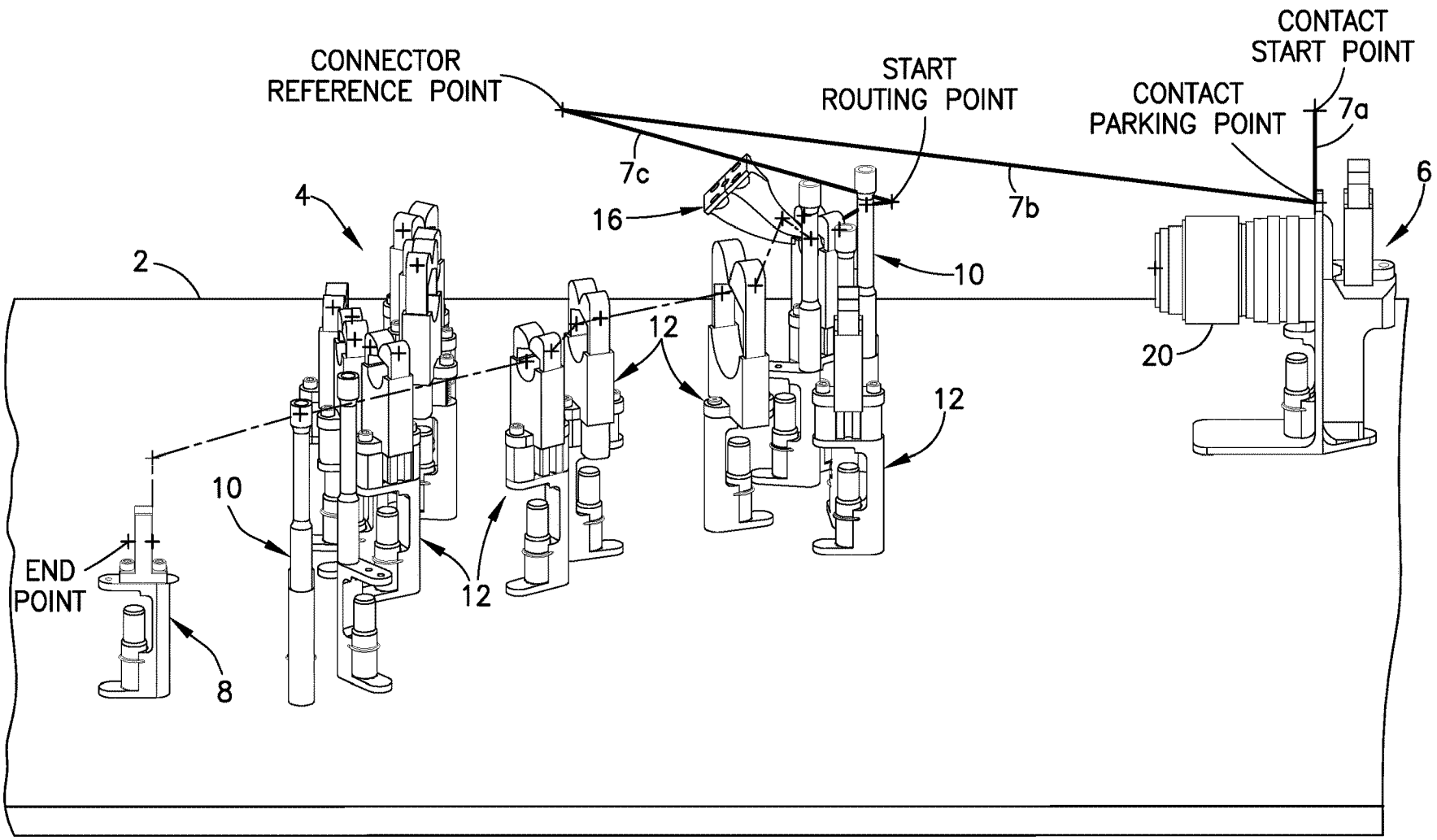
Figure 8I:
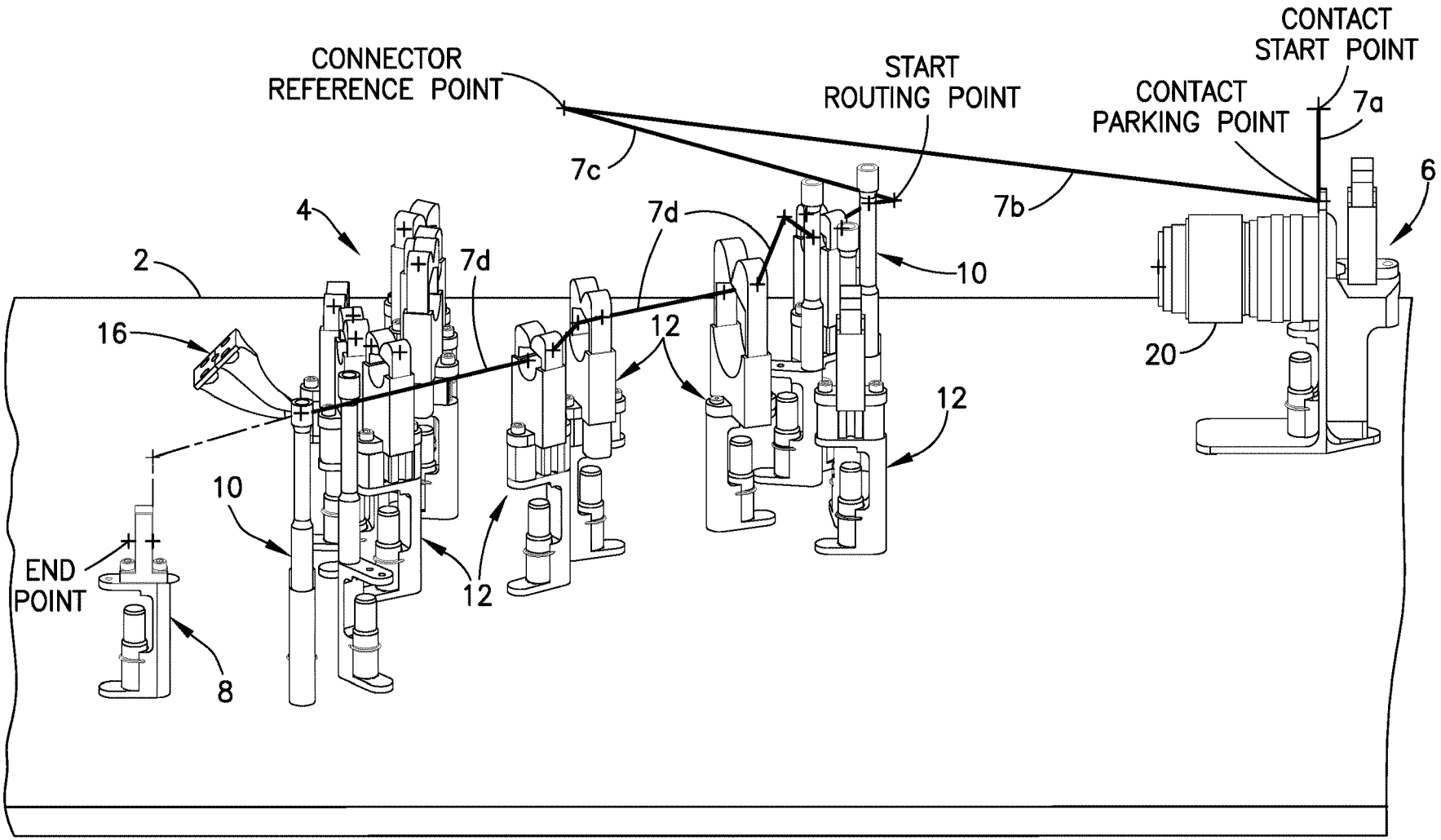

After the contact has been inserted into the first-end connector 20, the contact-insertion end effector 18 is moved to a location where the contact-insertion end effector 18 will not obstruct the wire-routing end effector 14. FIG. 8F is a diagram showing a three-dimensional view of the form board assembly depicted in FIG. 8E at the next stage of the planned wire routing process. FIG. 8F shows the location of the routing beak 16 after the TCP has been moved from the Connector Reference Point to the Start Routing Point. This movement of the TCP is indicated by bold line 7*c* in FIG. 8F.

During movement of the TCP from the Connector Reference Point to the Start Routing Point, the contact 3 remains inside the first-end connector and the wire terminated by that contact does not move in a lengthwise direction. As the routing beak 16 travels along the wire in a direction toward the first-end connector 20, the drive roller 73 is driven to rotate in a direction that causes a length of wire to be reeled back into the wire-routing end effector 14.

When the TCP reaches the Start Routing Point, the robot controller initiates execution of a program that controls a sequence of movements of the wire-routing end effector 14, which movements include rotations and translations. The movements are controlled in accordance with a predefined program that specifies a TCP path designed to route the wire through or around selected form board devices 4 attached to the form board 2. One example sequence of movements is depicted in FIGS. 8G-8J, which show the TCP being moved from the Start Routing Point to a point above the wire end holding device 8. These movements of the TCP are indicated by bold lines 7*d* in FIGS. 8I and 8J.

Figure 8J:
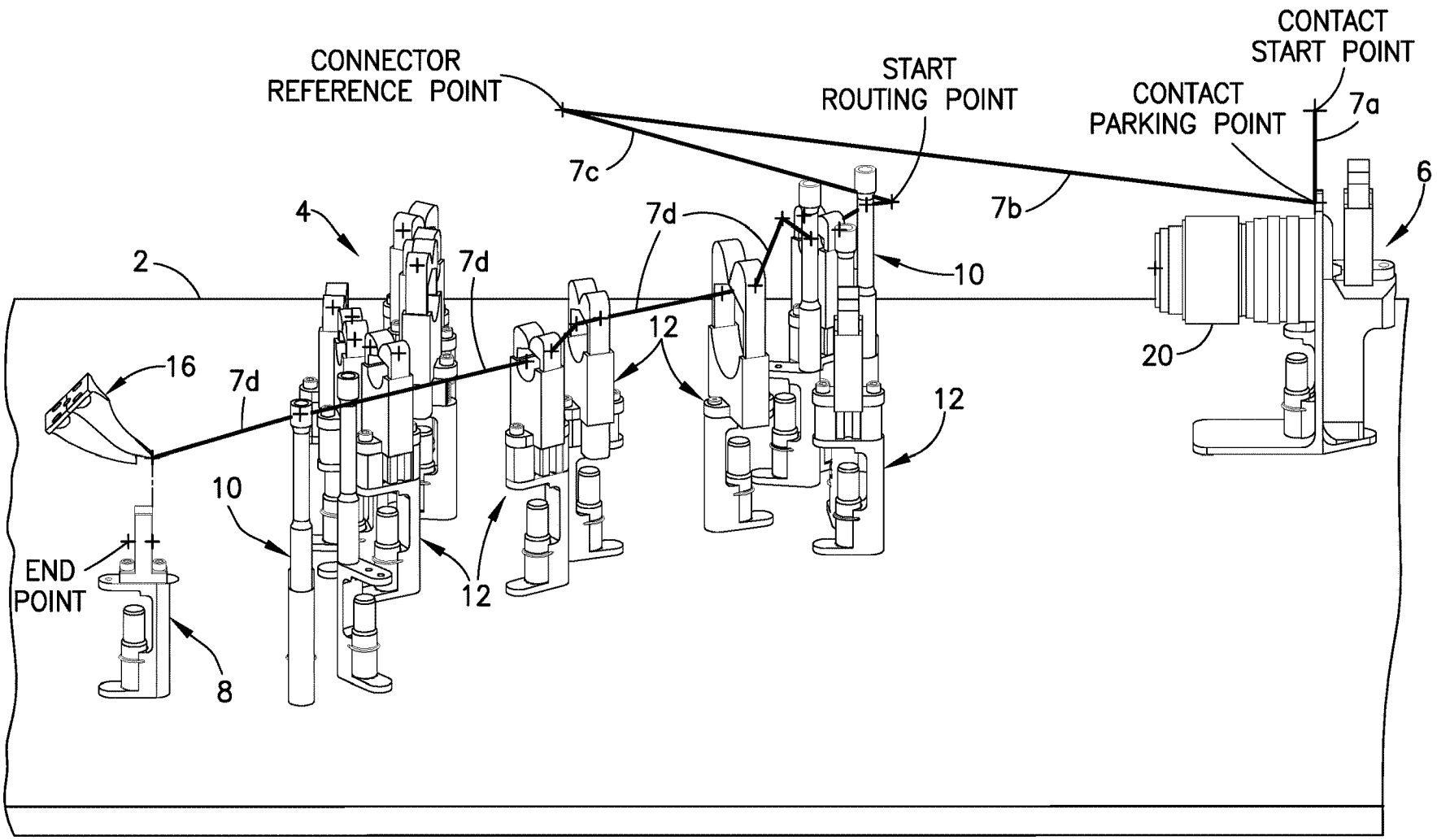
Figure 8K:
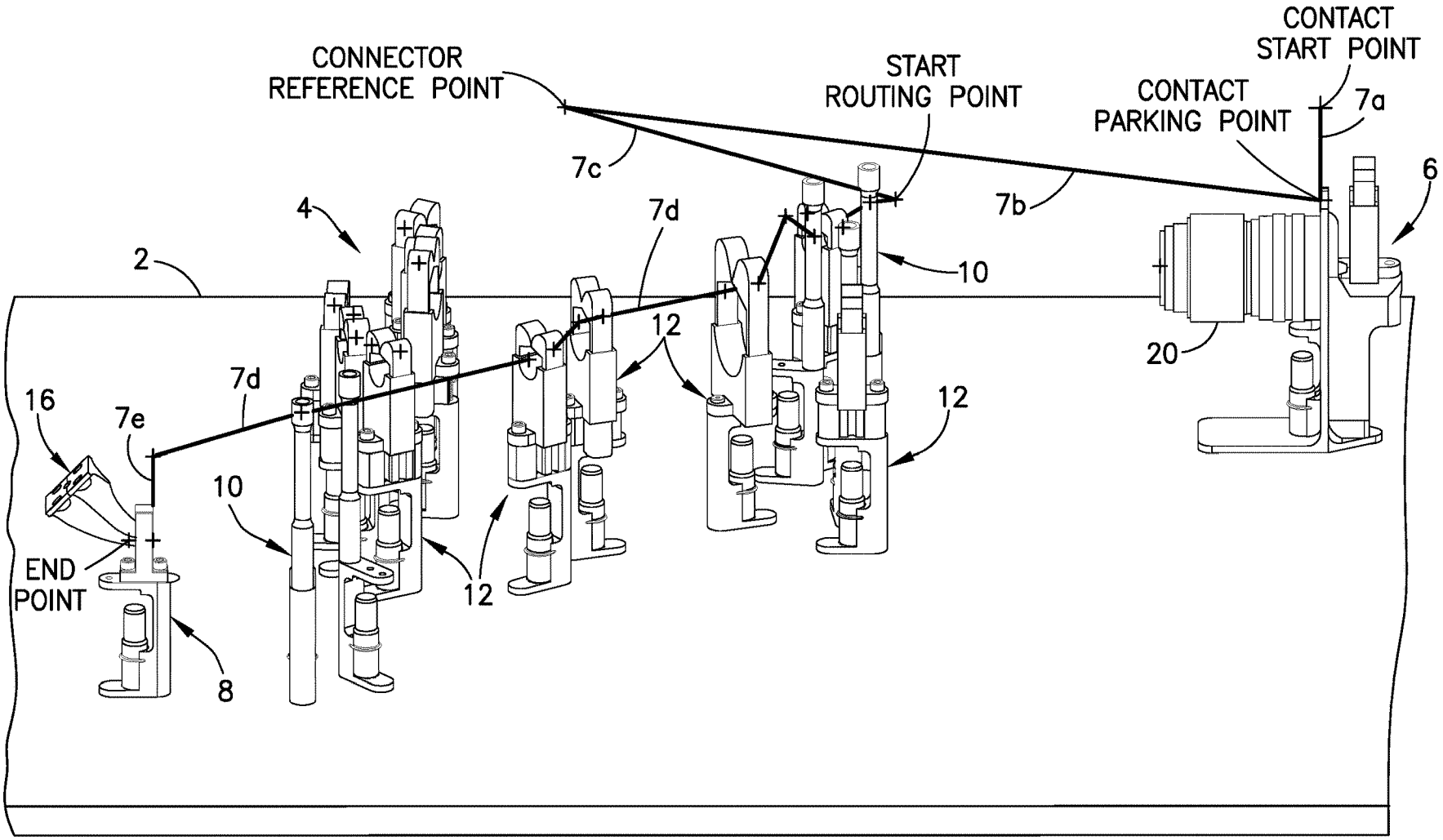
Figure 8L:
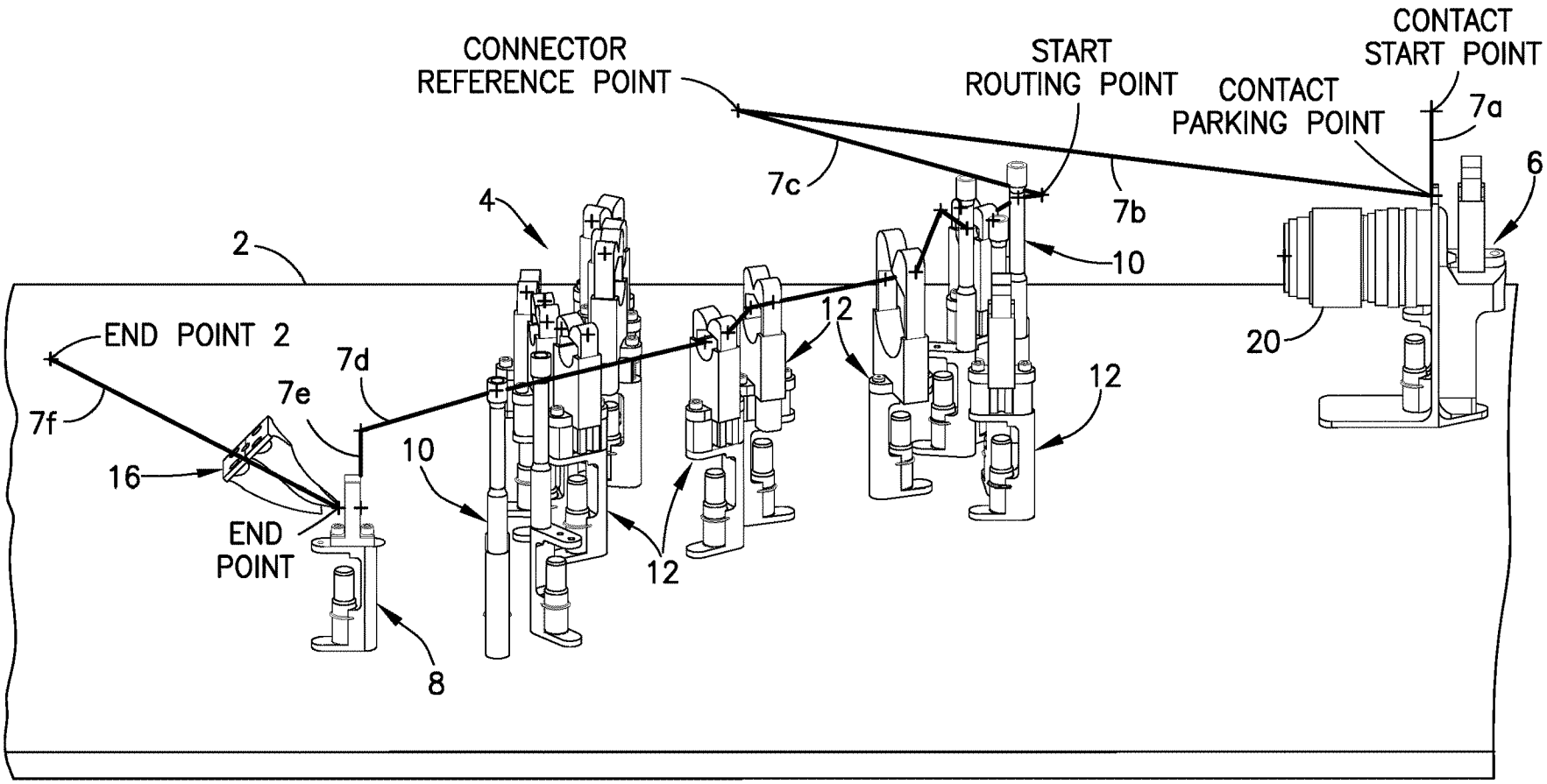
Figure 10:
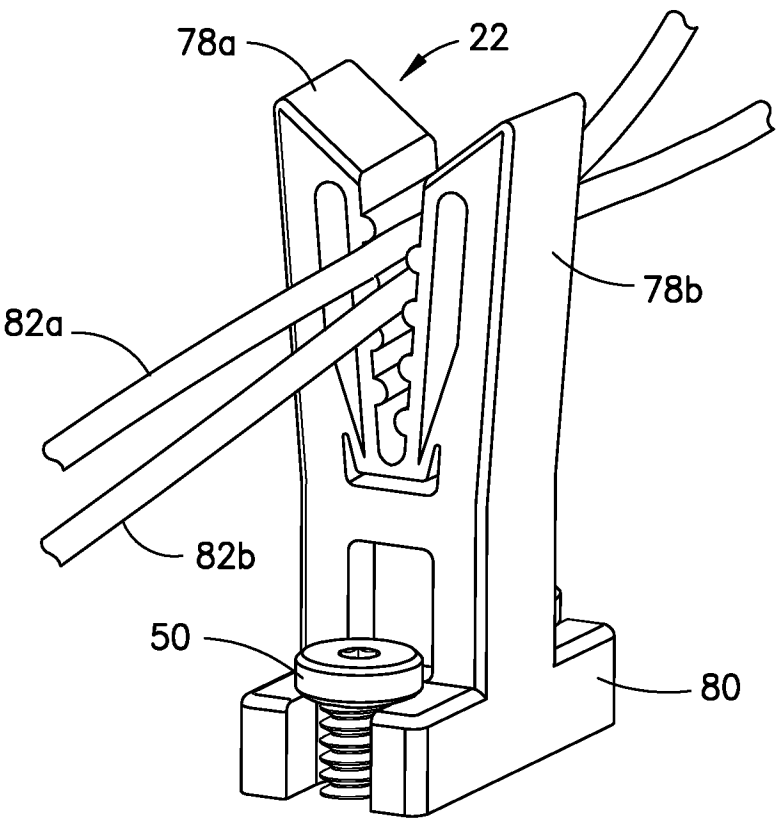
FIG. 10 is a diagram representing a three-dimensional view of a wire clip of the wire end holder depicted in FIG. 5 gripping respective end portions of two wires.

FIG. 8J shows the routing beak 16 overlying the wire end holding device 8. At this juncture, the wire-routing end effector 14 is controlled such that the routing beak 16 is displaced downward. FIG. 8K shows the location of the routing beak 16 after the TCP has been displaced vertically downward toward the End Point. This downward displacement of the TCP is indicated by bold vertical line 7*e* in FIG. 8K. During this downward displacement, the tip of the routing beak 16 is inserted into the gap G between the prongs 78*a* and 78*b* of the wire clip 22 (see FIG. 5). The material of prongs 78*a* and 78*b* should be sufficiently resilient to allow the tip of the routing beak 16 to push through the wire clip 22. Then the routing beak 16 is moved horizontally to the End Point as shown in FIG. 8L. This horizontal movement removes the tip of the routing beak 16 from the gap G, while dispensing a short segment of wire that remains between the prongs 78*a* and 78*b* of the wire end holding device 8. The prongs 78*a* and 78*b* will maintain the position of the wire. FIG. 10 shows a three-dimensional view of a wire clip 22 gripping respective end portions of two wires 82*a* and 82*b*.

After the TCP is positioned at the End Point, the receiving beak 16 is moved such that the TCP follows the TCP path segment indicated by bold line 7*f* in FIG. 8L. The length of the TCP path segment is sufficient to fully clear the wire from the wire-routing end effector 14. The empty reelette of the wire-routing end effector 14 is then removed and replaced by a reelette containing the next wire to be routed.

In accordance with one embodiment, wire routing occurs in a routing cell. First, the operator inserts a form board into the routing cell and informs the robot system of the configuration of the form board by scanning a barcode on the form board. Then the operator loads a rack of reelettes into the routing cell. Then the robot system routes wires on the form board, one wire at a time. The robot system determines which wire reelettes are available for it to pick (by reading barcodes on the reelettes) and compares the available wires to the wires listed in a wire data control file. The robot system is configured to load the reelette closest to the top of the sequence given by the wire data control file onto the wire-routing end effector. Then the robot system identifies the routing path from the wire data control file and routes the wire following this path using the wire-routing end effector. The robot system also uses a contact-insertion end effector to pick the first end of the wire and either insert it into the first-end connector or place it in an adjacent wire end holder, as specified in the wire data control file. Upon completion of the wire routing operation, the robot system applies plastic wire ties using a wire tie control file. Then the robot system cuts second-end branches using a branch cut control file.

Software algorithms ensure that the wire-routing end effector 14 does not have any hard collisions with the form board devices 4 or any previously routed wires during the routing process. A "hard collision" is one that causes damage to wires, connectors, form board devices, form board, end effectors, or robots.

As previously described, some of the form board devices 4 depicted in FIGS. 8A-8L are elastic retainer wire routing devices 12 of the type depicted in FIG. 3. Each elastic retainer wire routing device 12 includes a respective routing clip 36. The TCP path for the wire-routing end effector 14 includes path segments designed to guide the wire into the space between the arms 47*a*, 47*b* of the routing clip 36.

Figure 15:
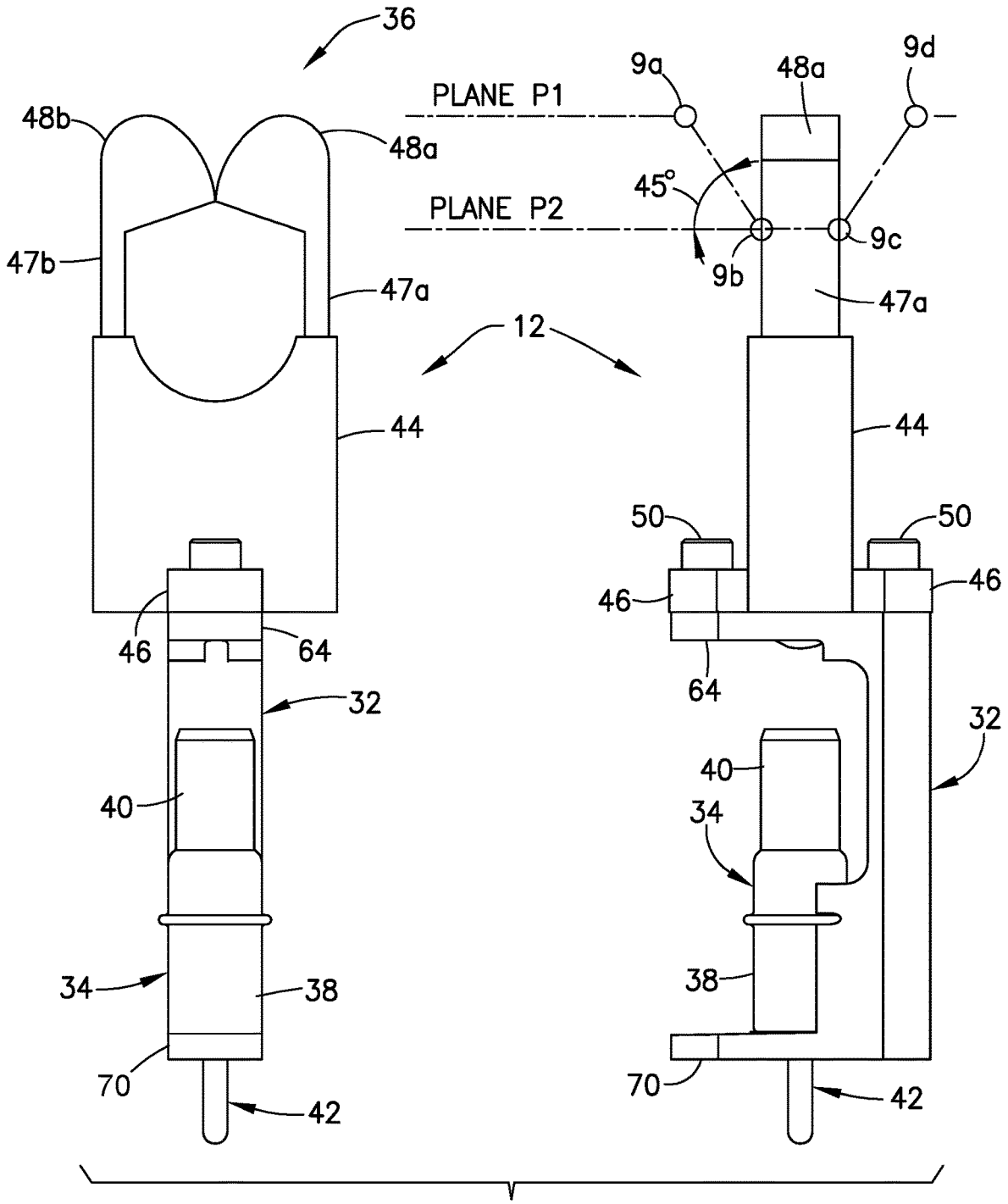
FIG. 15 includes diagrams representing front and side views of a wire routing device, which diagrams includes chained lines indicating two planes at different elevations. The four small circles in the side view on the right-hand side of FIG. 15 indicate successive positions of the tool control point, which descends from plane P1 to plane P2, travels in plane P2 through the routing clip in order to route a wire therethrough and then ascends to plane P1.

FIG. 15 includes diagrams representing front and side views of an elastic retainer wire routing device 12. These diagrams include chained lines indicating a plane P1 at a first elevation and a plane P2 at a second elevation lower than the first elevation. The first elevation may be equal to the height of the elastic retainer wire routing device 12. The four small circles in the side view on the right-hand side of FIG. 15 indicate successive positions 9*a*-9*d* of the TCP, which descends at a 45-degree angle from position 9*a* in plane P1 to position 9*b* in plane P2, travels in plane P2 from position 9*b* to position 9*c* (passing through the routing clip), and then ascends at a 45-degree angle from position 9*c* in plane P2 to position 9*d* in plane P1. As the tip of the routing beak (not shown in FIG. 15) moves from position 9*b* to position 9*c*, a short segment of the wire is dispensed from the routing beak. That portion of the wire will be retained between the routing clip arms 47*a*, 47*b* as the wire-routing end effector 14 continues toward the next form board device 4 on the form board 2.

Figure 11A:
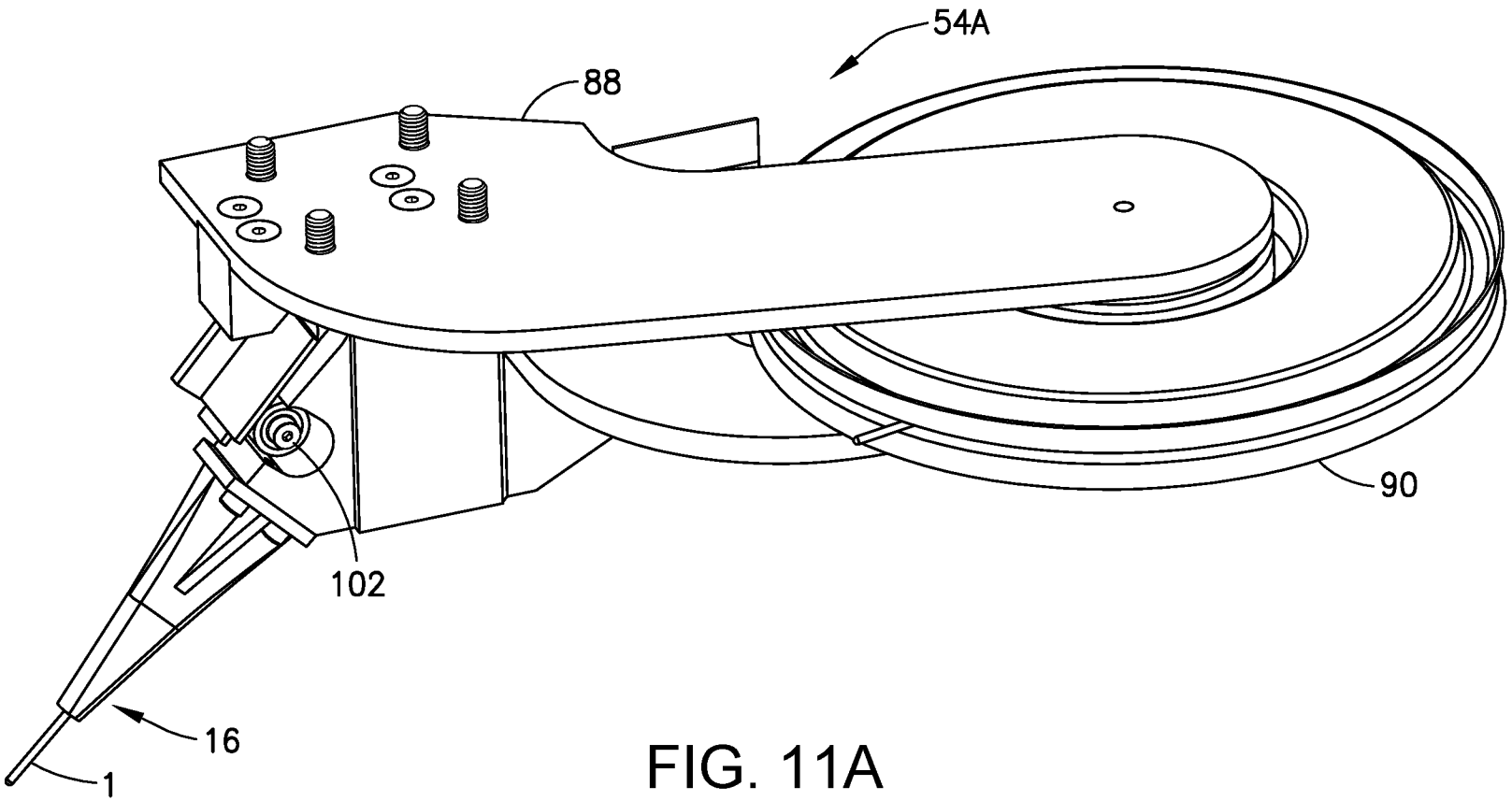
FIGS. 11A and 11B are diagrams representing respective three-dimensional views of a passive (unpowered) wire-routing end effector in accordance with another embodiment.
Figure 11B:
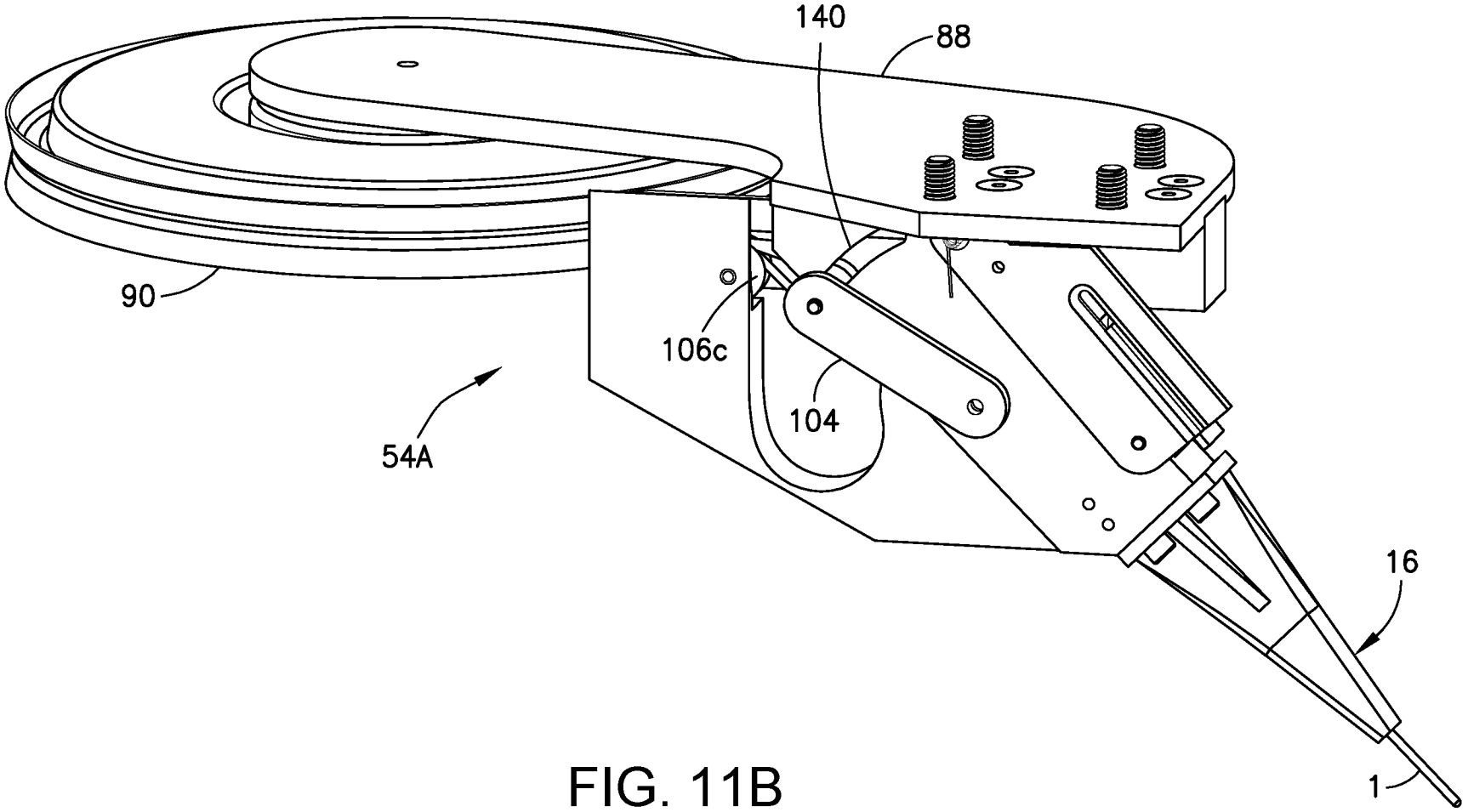
Figure 12:
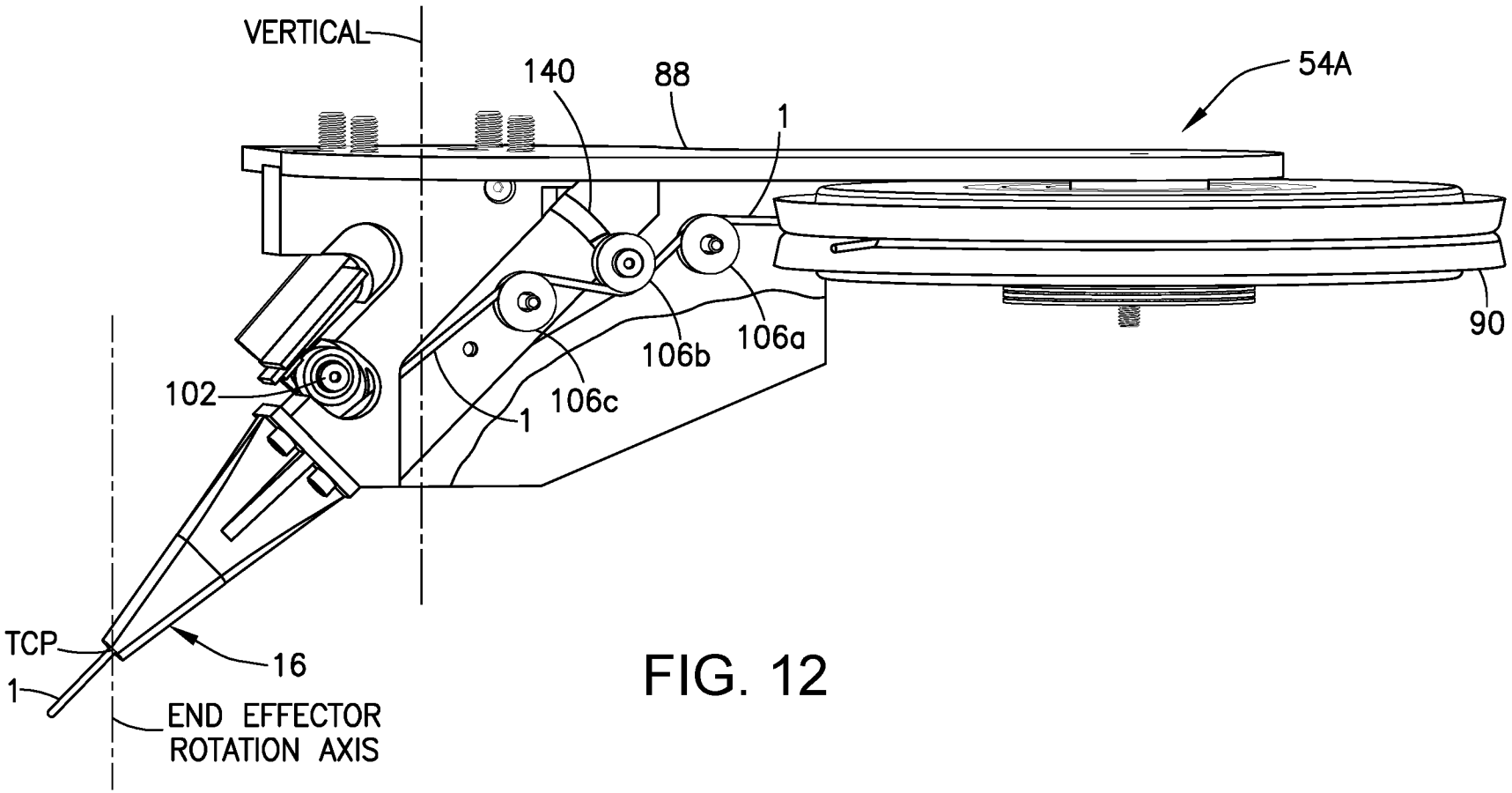
FIG. 12 is a diagram representing a side view of the passive wire-routing end effector depicted in FIGS. 11A and 11B.

In alternative embodiments, a wire-routing end effector that is not powered may be used to route a wire on a form board. FIGS. 11A and 11B are diagrams representing respective three-dimensional views of a passive (unpowered) wire-routing end effector 54A in accordance with one alternative embodiment. FIG. 12 is a diagram representing a side view of the passive wire-routing end effector 54A depicted in FIGS. 11A and 11B. The passive wire-routing end effector 54A includes a frame 88 and a reelette 90 rotatably coupled to the frame 88. The frame 88 may be mounted to the bottom of a force/torque sensor of the type previously described. The passive wire-routing end effector 54A further includes a routing beak 16 having a channel through which a wire 1 is dispensed. Prior to the start of a wire routing operation, the majority of the wire 1 is contained within the reelette 90.

Referring to FIGS. 11A and 12, the passive wire-routing end effector 54A further includes a wire length measurement encoder roller 102 which is rotatably coupled to the frame 88. The wire length measurement encoder roller 102 is operatively coupled to a rotary encoder of the type previously described. The rotary encoder is configured to convert each incremental rotation of the wire length measurement encoder roller 102 into a signal representing encoder data. Each incremental rotation of the wire length measurement encoder roller 102 corresponds to an incremental advancement of the wire 1. A computer may be programmed to calculate the wire length based on the stored encoder data. Thus, assuming that there is no slippage between the wire 1 and the wire length measurement encoder roller 102, the length of wire 1 dispensed during a routing operation may be measured.

The passive wire-routing end effector 54A further includes a passive tensioner arm 104 (shown in FIG. 11B) and three passive tension rollers 106*a*-*c* (shown in FIG. 12). One end of passive tensioner arm 104 is rotatably coupled to frame 88. Passive tension rollers 106*a* and 106*c* are also rotatably coupled to frame 88. Passive tension roller 106*b* is rotatably coupled to a shaft connected to the other end of passive tensioner arm 104. That shaft moves in an arcuate slot 140 formed in the frame 88 as the passive tensioner arm 104 swings between two limit angular positions dictated by the opposing ends of the arcuate slot 140.

As seen in FIG. 12, the wire 1 is passed over passive tension roller 106*a*, under passive tension roller 106*b* and over passive tension roller 106*c*. The passive tensioner arm 104 is spring-loaded. The spring urges the passive tensioner arm 104 to rotate in a clockwise direction as seen from the vantage point of FIG. 12. The passive tension roller 106*b* converts the spring force into increased tension in the wire 1.

As the passive wire-routing end effector 54A moves in the volume of space above the form board 2, the vertical axis indicated in FIG. 12 (which is perpendicular to the horizontal upper plate of the frame 88) is maintained vertical relative to the horizontal plane of the form board 2. In addition, when the TCP of the passive wire-routing end effector 54A is being moved along an arcuate TCP path, the passive wire-routing end effector 54A is rotated about an end effector rotation axis which intersects the TCP and is parallel to the vertical axis.

Figure 13:
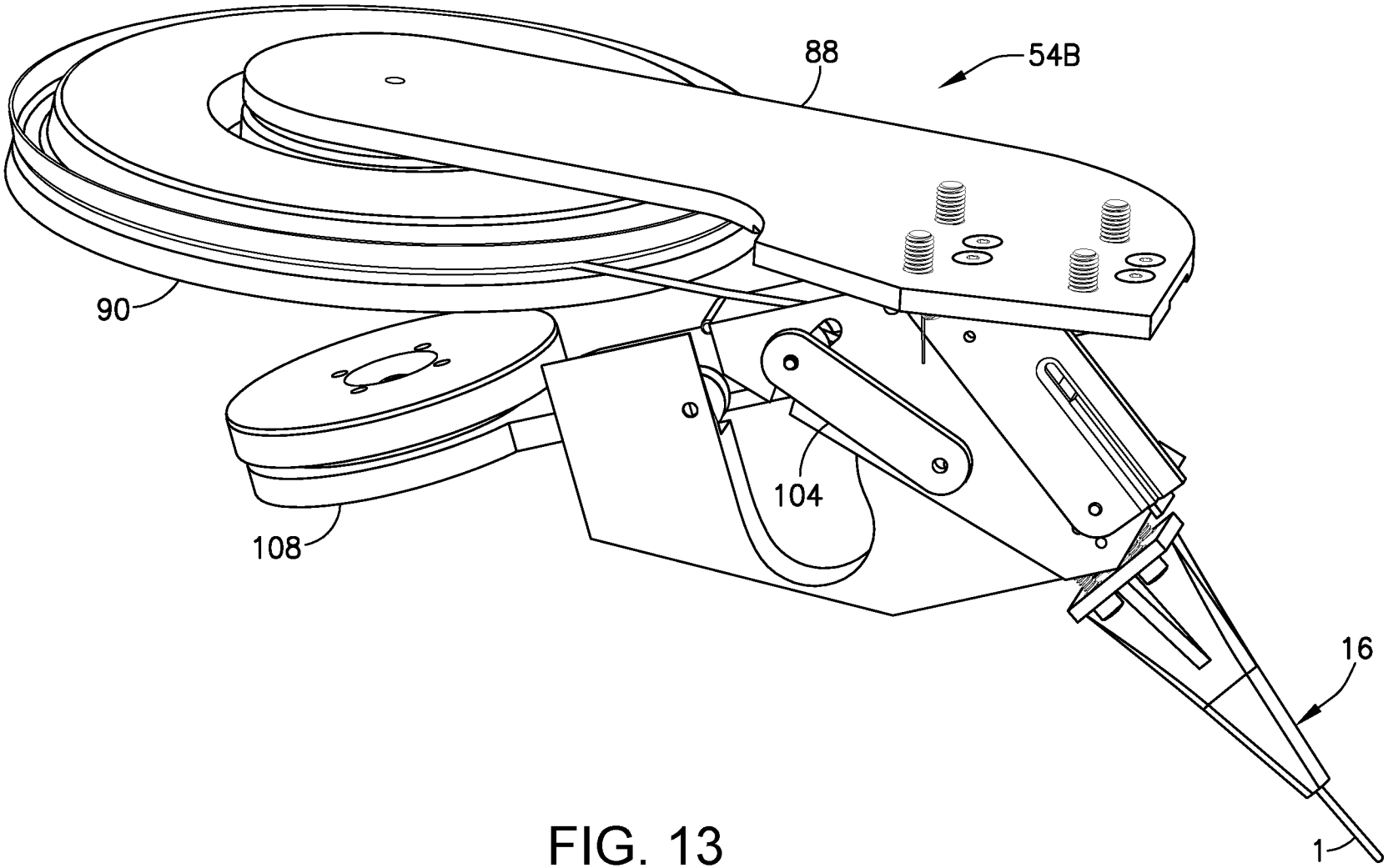
FIGS. 13 and 14 are diagrams representing respective three-dimensional views of a passive wire-routing end effector configured to retain a reelette in either of two locations in accordance with another embodiment.
Figure 14:
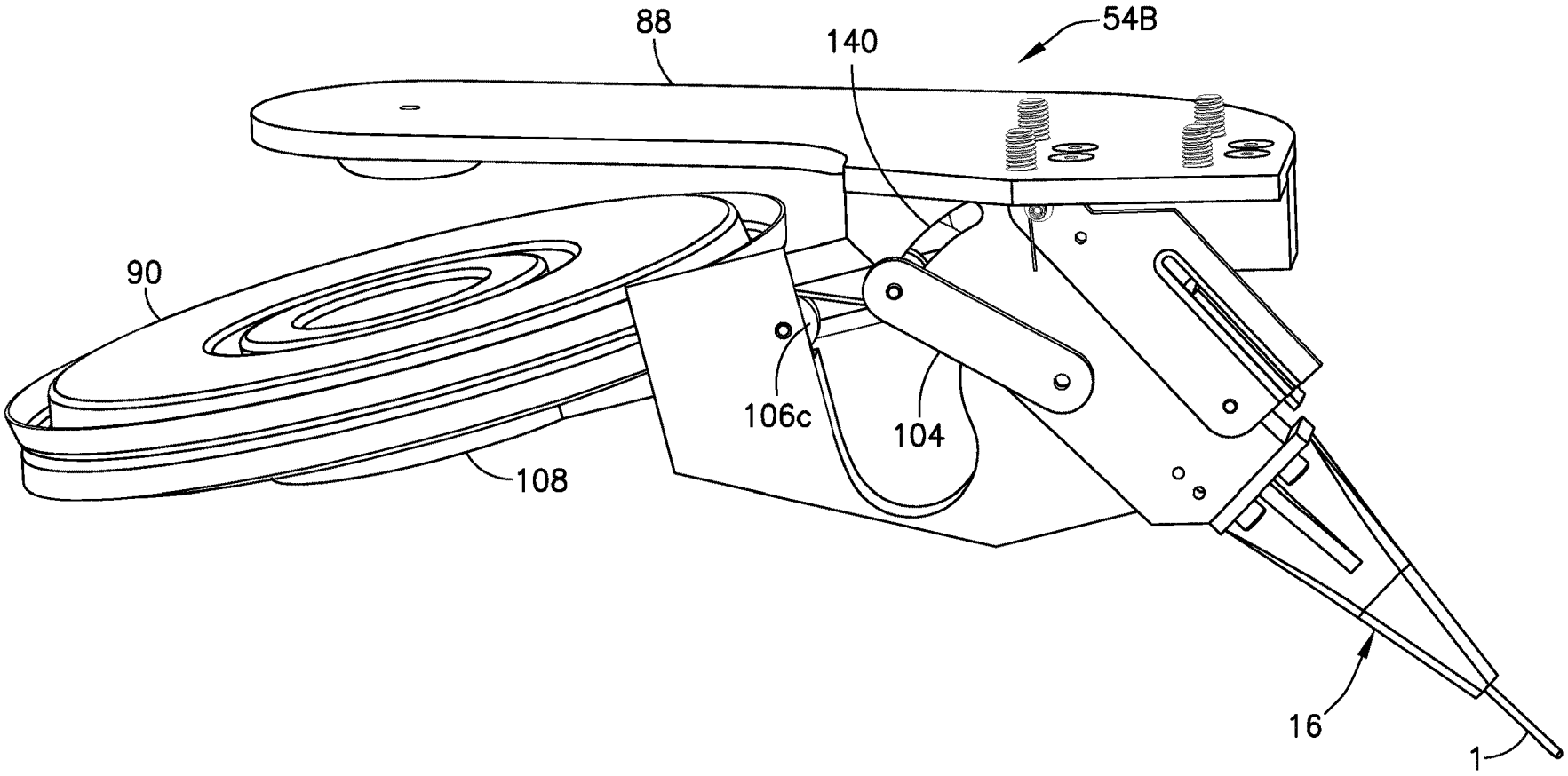

FIGS. 13 and 14 are diagrams representing respective three-dimensional views of a passive wire-routing end effector 54B which is configured to retain a reelette 90 in either of two locations in accordance with another embodiment. In the configuration depicted in FIG. 13, gravity holds the reelette 90 downward on a reelette service base (not shown) such that the end effector can pick up the reelettes more easily. In the alternative configuration depicted in FIG. 14, gravity holds the reelette 90 downward on a hub, allowing for a simpler and more robust hub design.

Figure 18:
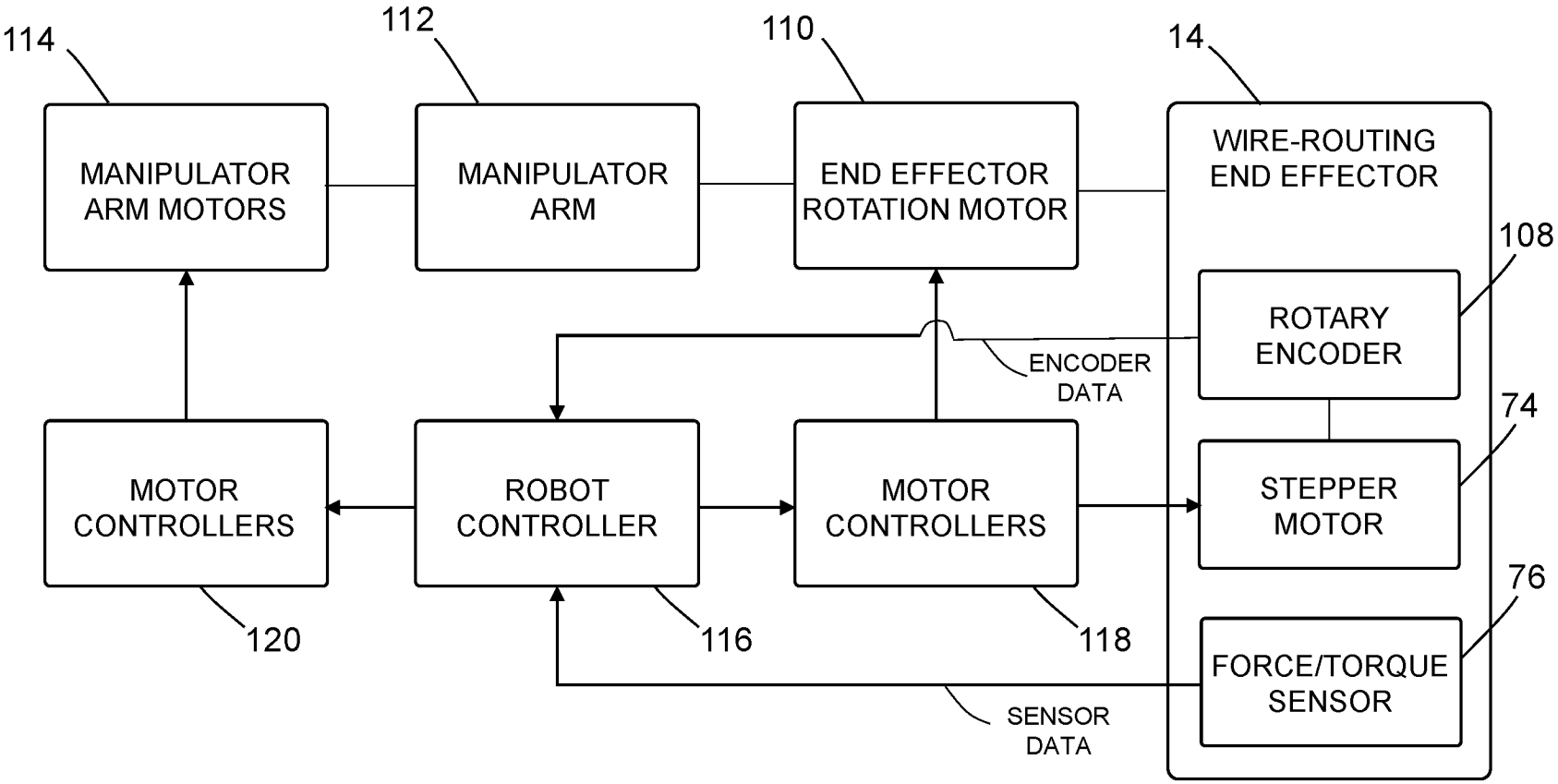
FIG. 18 is a block diagram identifying components of an automated system for routing a wire through form board devices attached to a form board in accordance with one embodiment.

FIG. 18 is a block diagram identifying components of an automated (robot) system for routing a wire through form board devices attached to a form board in accordance with one embodiment. The automated system includes a robot controller 116 (e.g., a computer or processor) that is configured (e.g., programmed) to coordinate the operation of all motors. The robot system further includes a manipulator arm 112 and a wire-routing end effector 14 which is rotatably coupled to the distal end of the manipulator arm 112. The wire-routing end effector 14 is rotated relative to the distal end of the manipulator arm 112 by an end effector rotation motor 110. The manipulator arm 112 further includes a plurality of links coupled by joints. The distal end of the manipulator arm 112 may be moved by activating one or more of a plurality of manipulator arm motors 114. For example, a manipulator arm motor 114 is configured to cause one link to rotate about an axis of the joint that couples the one link to another link. The robot controller 116 sends commands to motor controllers 120 which in turn control operation of the manipulator arm motors 114. Similarly, the robot controller 116 sends commands to motor controllers 118 which in turn control operation of the end effector rotation motor 110 and the stepper motor 74 of the wire-routing end effector 14. As previously described, the robot controller 116 receives encoder data from a rotary encoder 108 and sensor data from the force/torque sensor 76, both of which are incorporated in the wire-routing end effector 14. The robot controller 116 is capable of controlling the position and orientation of the wire-routing end effector 14 in dependence on the wire tension as measured by the force/torque sensor 76. The robot controller 116 may be configured to store the encoder data in a non-transitory tangible computer-readable storage medium for post-processing by a different computer.

The robot system may be in the form of a pedestal robot or a gantry robot. A gantry robot consists of a manipulator mounted onto an overhead system that allows movement across a horizontal plane. Gantry robots are also called Cartesian or linear robots. The pedestal robot may have multi-axis movement capabilities. An example of a robot that could be employed with the wire-routing end effector is robot Model KR-150 manufactured by Kuka Roboter GmbH (Augsburg, Germany), although any robot or other manipulator capable of controlling the location of the routing beak 16 in the manner disclosed herein may be used.

While methods and apparatus for robot motion control and wire dispensing during automated routing of wires onto harness form boards have been described with reference to various embodiments, it will be understood by those skilled in the art that various changes may be made and equivalents may be substituted for elements thereof without departing from the scope of the teachings herein. In addition, many modifications may be made to adapt the teachings herein to a particular situation without departing from the scope thereof. Therefore it is intended that the claims not be limited to the particular embodiments disclosed herein.

As used herein, the term "computer system" should be construed broadly to encompass a system having at least one computer or processor, and which may have multiple computers or processors that communicate through a network or bus. As used in the preceding sentence, the terms "computer" and "processor" both refer to devices comprising a processing unit (e.g., a central processing unit) and some form of memory (i.e., a non-transitory tangible computer-readable storage medium) for storing a program which is readable by the processing unit.

The methods described herein may be encoded as executable instructions embodied in a non-transitory tangible computer-readable storage medium, including, without limitation, a storage device and/or a memory device. Such instructions, when executed by a computer system, cause the wire routing end effector to perform at least a portion of the methods described herein.

The process claims set forth hereinafter should not be construed to require that the steps recited therein be performed in alphabetical order (any alphabetical ordering in the claims is used solely for the purpose of referencing previously recited steps) or in the order in which they are recited unless the claim language explicitly specifies or states conditions indicating a particular order in which some or all of those steps are performed. Nor should the process claims be construed to exclude any portions of two or more steps being performed concurrently or alternatingly unless the claim language explicitly states a condition that precludes such an interpretation.

The invention claimed is:

1. A wire-routing end effector comprising:

a lower frame;

a routing beak fastened to and projecting from the lower frame, wherein the routing beak has a channel configured to guide a wire along a predetermined path relative to the lower frame as the wire moves through the channel, wherein the routing beak comprises an upper beak part having a first groove and a lower beak part having a second groove, wherein the first and second grooves form the channel, and wherein the upper beak part projects forward beyond the lower beak part, thereby limiting upward movement of a portion of the wire positioned under an overhang;

a drive roller comprising a drive roller shaft rotatably coupled to the lower frame, wherein the drive roller is arranged to contact a portion of the wire being guided in the channel of the routing beak;

a motor having a motor output shaft; and a drive train which operatively couples the drive roller to the motor.

2. The wire-routing end effector as recited in claim 1, wherein the drive train comprises:

a roller drive train operatively coupled to the motor output shaft;

a drive shaft operatively coupled to the roller drive train so that the drive shaft rotates when the motor output shaft rotates;

a first right-angled drive shaft gear mounted to one end of the drive shaft; and a second right-angled drive shaft gear mounted to one end of the drive roller shaft and intermeshed with the first right-angled drive shaft gear, wherein the first and second right-angled drive shaft gears convert rotation of the drive shaft to rotation of the drive roller shaft.

3. The wire-routing end effector as recited in claim 2, wherein the roller drive train comprises a first rubber drive roller affixed to the motor output shaft, a third rubber drive roller coupled to the drive shaft so that the drive shaft rotates when the third rubber drive roller rotates, and a second rubber drive roller configured to convert rotation of the first rubber drive roller to rotation of the third rubber drive roller, further comprising a slotted drive bearing that transmits torque from the third rubber drive roller to the drive shaft while allowing the drive shaft to move up and down.

4. The wire-routing end effector as recited in claim 2, further comprising:

a force/torque sensor attached to the lower frame and configured to output sensor data representing a force being exerted on the force/torque sensor by the lower frame; and an upper frame that is attached to the force/torque sensor, wherein the motor is mounted to the upper frame, the roller drive train is rotatably coupled to the upper frame, and the drive shaft is respectively rotatable about and movable along an axis of the drive shaft.

5. The wire-routing end effector as recited in claim 4, further comprising a reelette coupled to the upper frame and configured to contain at least a portion of the wire being guided by the routing beak.

6. An apparatus for routing a wire, comprising a manipulator arm, a wire-routing end effector coupled to a distal end of the manipulator arm of a robot, and a robot controller configured to control movement of the manipulator arm and rotation of the wire-routing end effector relative to the manipulator arm by activating one or more of a plurality of manipulator arm motors, wherein the wire-routing end effector comprises:

a lower frame; and a routing beak fastened to and projecting from the lower frame, wherein the routing beak has a height which decreases from a point of attachment to the lower frame to a tip of the routing beak and has a channel configured to guide a wire along a predetermined path relative to the lower frame as the wire moves through the channel, wherein the routing beak comprises an upper beak part having a first groove and a lower beak part having a second groove, wherein the first and second grooves form the channel, and wherein the upper beak part projects forward beyond the lower beak part, thereby limiting upward movement of a portion of the wire positioned under an overhang.

7. The apparatus as recited in claim 6, further comprising:

a force/torque sensor attached to the lower frame and configured to output sensor data representing a force being exerted on the force/torque sensor by the lower frame, wherein the robot controller is communicatively coupled to receive the sensor data from the force/torque sensor and further configured to control movement of the manipulator arm by activating the arm motors in response to the received sensor data.

8. The apparatus as recited in claim 6, further comprising a reelette rotatably coupled to the lower frame, wherein the reelette is configured to contain a portion of the wire being guided by the routing beak.

9. The apparatus as recited in claim 6, wherein the robot controller is configured to control the operation of the manipulator arm motors and hence the movement of the manipulator arm such that an axis of rotation of the wire-routing end effector relative to the manipulator arm is vertical and the tip of the routing beak is the lowest point of the wire-routing end effector as the tip of the routing beak travels along a predefined routing path.

10. The apparatus as recited in claim 6, wherein the wire-routing end effector further comprises:

an encoder roller rotatably coupled to the lower frame and configured to contact the wire being passed through the routing beak; and a rotary encoder coupled to the encoder roller and configured to convert each incremental rotation of the encoder roller into a signal representing rotary encoder data indicating a direction of each incremental rotation of the encoder roller, wherein the robot controller is communicatively coupled to receive the rotary encoder data and further configured to calculate a length of wire dispensed by the wire-routing end effector based on the received rotary encoder data.

11. The apparatus as recited in claim 7, wherein the wire-routing end effector further comprises:

an upper frame that is rotatably coupled to the manipulator arm; and a reelette rotatably coupled to the upper frame and configured to contain at least a portion of the wire being guided by the routing beak, wherein the force/torque sensor is further attached to the upper frame.

12. The apparatus as recited in claim 11, wherein the wire-routing end effector further comprises:

a drive roller comprising a drive roller shaft rotatably coupled to the lower frame;

a motor mounted to the upper frame;

a roller drive train rotatably coupled to the upper frame and operatively coupled to the motor;

a drive shaft operatively coupled to the motor by way of the roller drive train;

a first right-angled drive shaft gear mounted to one end of the drive shaft; and a second right-angled drive shaft gear mounted to one end of the drive roller shaft and intermeshed with the first right-angled drive shaft gear, wherein the drive roller is configured to rotate in response to activation of the motor by the robot controller.

13. The apparatus as recited in claim 12, wherein the wire-routing end effector further comprises: an idle guide spring clamp arm rotatably coupled to the lower frame; an idle guide roller comprising an idle guide roller shaft that is rotatably coupled to the idle guide spring clamp arm; and a spring configured to urge the idle guide spring clamp arm to rotate in a first rotation direction toward a position at which the idle guide roller forms a nip with the drive roller, wherein the idle guide roller is configured to displace away from the drive roller when the idle guide spring clamp arm is rotated in a second rotation direction opposite to the first rotation direction.

14. The apparatus as recited in claim 6, further comprising: first and second passive tensioner rollers rotatably coupled to the lower frame for rotation about respective parallel axes; a passive tensioner arm rotatably coupled to the lower frame; and a third passive tension roller rotatably coupled to one end of the passive tensioner arm for rotation about an axis that is parallel to the axes of rotation of the first and second passive tensioner rollers, wherein the passive tensioner arm is rotatable to between a first angular position where the third passive tension roller is positioned between the first and second passive tensioner rollers and a second angular position where the third passive tension roller is not positioned between the first and second passive tensioner rollers.

15. A wire-routing end effector comprising:

a lower frame; and a routing beak fastened to and projecting from the lower frame, wherein the routing beak has a height which decreases from a point of attachment to the lower frame to a tip of the routing beak and has a channel configured to guide a wire along a predetermined path relative to the lower frame as the wire moves through the channel, wherein the routing beak comprises an upper beak part having a first groove and a lower beak part having a second groove, wherein the first and second grooves form the channel, and wherein the upper beak part projects forward beyond the lower beak part, thereby limiting upward movement of a portion of the wire positioned under an overhang.

16. The wire-routing end effector as recited in claim 15, further comprising a force/torque sensor attached to the lower frame and configured to output sensor data representing a force being exerted on the force/torque sensor by the lower frame.

17. The wire-routing end effector as recited in claim 16, further comprising:

an upper frame that is rotatably coupled to a manipulator arm; and a reelette rotatably coupled to the upper frame and configured to contain at least a portion of the wire being guided by the routing beak, wherein the force/torque sensor is further attached to the upper frame.

18. The wire-routing end effector as recited in claim 17, further comprising:

a drive roller comprising a drive roller shaft rotatably coupled to the lower frame;

a motor mounted to the upper frame;

a roller drive train rotatably coupled to the upper frame and operatively coupled to the motor;

a drive shaft operatively coupled to the motor by way of the roller drive train;

a first right-angled drive shaft gear mounted to one end of the drive shaft; and a second right-angled drive shaft gear mounted to one end of the drive roller shaft and intermeshed with the first right-angled drive shaft gear.

19. The wire-routing end effector as recited in claim 18, further comprising: an idle guide spring clamp arm rotatably coupled to the lower frame; an idle guide roller comprising an idle guide roller shaft that is rotatably coupled to the idle guide spring clamp arm; and a spring configured to urge the idle guide spring clamp arm to rotate in a first rotation direction toward a position at which the idle guide roller forms a nip with the drive roller, wherein the idle guide roller is configured to displace away from the drive roller when the idle guide spring clamp arm is rotated in a second rotation direction opposite to the first rotation direction.

20. The wire-routing end effector as recited in claim 18, further comprising a rotary encoder configured to output a signal representing encoder data indicating a direction of each incremental rotation of the drive roller.

* * * * *